US009975176B2

(12) United States Patent
Rutkowski

(10) Patent No.: US 9,975,176 B2
(45) Date of Patent: May 22, 2018

(54) METHOD AND ASSEMBLY FOR FORMING COMPONENTS HAVING INTERNAL PASSAGES USING A LATTICE STRUCTURE

(71) Applicant: General Electric Company, Schenectady, NY (US)

(72) Inventor: Stephen Francis Rutkowski, Duanesburg, NY (US)

(73) Assignee: General Electric Company, Schenectady, NY (US)

( * ) Notice: Subject to any disclaimer, the term of this patent is extended or adjusted under 35 U.S.C. 154(b) by 0 days. days.

(21) Appl. No.: 15/410,295

(22) Filed: Jan. 19, 2017

(65) Prior Publication Data

US 2017/0173686 A1 Jun. 22, 2017

Related U.S. Application Data

(62) Division of application No. 14/973,039, filed on Dec. 17, 2015, now Pat. No. 9,579,714.

(51) Int. Cl.
*B22C 9/10* (2006.01)
*B22D 25/02* (2006.01)
(Continued)

(52) U.S. Cl.
CPC ..... *B22D 25/02* (2013.01); *B22C 9/10* (2013.01); *B22C 9/108* (2013.01); *B22C 9/24* (2013.01);
(Continued)

(58) Field of Classification Search
CPC ..... B22C 9/10; B22C 9/108; B22C 9/24
(Continued)

(56) References Cited

U.S. PATENT DOCUMENTS 2,687,278 A 8/1954 Smith et al.
2,756,475 A 7/1956 Hanink et al.
(Continued)

FOREIGN PATENT DOCUMENTS

CH 640440 A5 1/1984
EP 0025481 A1 3/1981
(Continued)

OTHER PUBLICATIONS

Ziegelheim, J. et al., "Diffusion bondability of similar/dissimilar light metal sheets," Journal of Materials Processing Technology 186.1 (May 2007): 87-93.
(Continued)

*Primary Examiner* — Kevin E Yoon
(74) *Attorney, Agent, or Firm* — Armstrong Teasdale LLP

(57) ABSTRACT

A method of forming a component having an internal passage defined therein includes selectively positioning a lattice structure at least partially within a cavity of a mold. The lattice structure is formed from a first material, and a core is positioned in a channel defined through the lattice structure, such that at least a portion of the core extends within the cavity. The method also includes introducing a component material in a molten state into the cavity, such that the component material in the molten state at least partially absorbs the first material from the lattice structure. The method further includes cooling the component material in the cavity to form the component, wherein at least the portion of the core defines the internal passage within the component.

17 Claims, 11 Drawing Sheets

(51) Int. Cl.

| | |
|---|---|
| ***B22C 9/24*** | (2006.01) |
| ***B22D 30/00*** | (2006.01) |
| ***F01D 5/18*** | (2006.01) |
| ***F04D 29/38*** | (2006.01) |

(52) U.S. Cl.
CPC ..... *B22D 30/00* (2013.01); *F01D 5/18* (2013.01); *F04D 29/388* (2013.01)

(58) Field of Classification Search
USPC ..... 164/30, 340, 369, 370, 397–400
See application file for complete search history.

(56) References Cited

U.S. PATENT DOCUMENTS

| | | | | |
|---|---|---|---|---|
| 2,991,520 | A | | 7/1961 | Dalton |
| 3,160,931 | A | | 12/1964 | Leach |
| 3,222,435 | A | | 12/1965 | Mellen, Jr. et al. |
| 3,222,737 | A | | 12/1965 | Reuter |
| 3,475,375 | A | | 10/1969 | Yates |
| 3,563,711 | A | | 2/1971 | Hammond et al. |
| 3,596,703 | A | | 8/1971 | Bishop et al. |
| 3,597,248 | A | | 8/1971 | Yates |
| 3,662,816 | A | | 5/1972 | Bishop et al. |
| 3,678,987 | A | | 7/1972 | Kydd |
| 3,689,986 | A | | 9/1972 | Takahashi et al. |
| 3,694,264 | A | | 9/1972 | Weinland et al. |
| 3,773,506 | A | | 11/1973 | Larker et al. |
| 3,824,113 | A | | 7/1974 | Loxley et al. |
| 3,844,727 | A | | 10/1974 | Copley et al. |
| 3,863,701 | A | | 2/1975 | Niimi et al. |
| 3,866,448 | A | | 2/1975 | Dennis et al. |
| 3,921,271 | A | | 11/1975 | Dennis et al. |
| 3,996,048 | A | | 12/1976 | Fiedler |
| 4,096,296 | A | | 6/1978 | Galmiche et al. |
| 4,130,157 | A | | 12/1978 | Miller et al. |
| 4,148,352 | A | | 4/1979 | Sensui et al. |
| 4,236,568 | A | | 12/1980 | Larson |
| 4,285,634 | A | | 8/1981 | Rossman et al. |
| 4,352,390 | A | | 10/1982 | Larson |
| 4,372,404 | A | | 2/1983 | Drake |
| 4,375,233 | A | | 3/1983 | Rossmann et al. |
| 4,375,266 | A | | 3/1983 | Rossmann et al. |
| 4,417,381 | A | | 11/1983 | Higginbotham |
| 4,432,798 | A | | 2/1984 | Helferich et al. |
| 4,487,246 | A | * | 12/1984 | Frasier ..... B22C 21/14 164/122.2 |
| 4,557,691 | A | | 12/1985 | Martin et al. |
| 4,576,219 | A | | 3/1986 | Uram |
| 4,583,581 | A | | 4/1986 | Ferguson et al. |
| 4,604,780 | A | | 8/1986 | Metcalfe |
| 4,637,449 | A | | 1/1987 | Mills et al. |
| 4,738,587 | A | | 4/1988 | Kildea |
| 4,859,141 | A | | 8/1989 | Maisch et al. |
| 4,905,750 | A | | 3/1990 | Wolf |
| 4,911,990 | A | | 3/1990 | Prewo et al. |
| 4,964,148 | A | | 10/1990 | Klostermann et al. |
| 4,986,333 | A | | 1/1991 | Gartland |
| 5,052,463 | A | | 10/1991 | Lechner et al. |
| 5,083,371 | A | | 1/1992 | Leibfried et al. |
| 5,243,759 | A | | 9/1993 | Brown et al. |
| 5,248,869 | A | | 9/1993 | DeBell et al. |
| 5,273,104 | A | | 12/1993 | Renaud et al. |
| 5,291,654 | A | | 3/1994 | Judd et al. |
| 5,295,530 | A | | 3/1994 | O'Connor et al. |
| 5,332,023 | A | | 7/1994 | Mills |
| 5,350,002 | A | | 9/1994 | Orton |
| 5,355,668 | A | | 10/1994 | Weil et al. |
| 5,371,945 | A | | 12/1994 | Schnoor |
| 5,387,280 | A | | 2/1995 | Kennerknecht |
| 5,394,932 | A | | 3/1995 | Carozza et al. |
| 5,398,746 | A | | 3/1995 | Igarashi |
| 5,413,463 | A | | 5/1995 | Chin et al. |
| 5,465,780 | A | | 11/1995 | Muntner et al. |
| 5,467,528 | A | | 11/1995 | Bales et al. |
| 5,468,285 | A | | 11/1995 | Kennerknecht |
| 5,482,054 | A | | 1/1996 | Slater et al. |
| 5,498,132 | A | | 3/1996 | Carozza et al. |
| 5,505,250 | A | | 4/1996 | Jago |
| 5,507,336 | A | | 4/1996 | Tobin |
| 5,509,659 | A | | 4/1996 | Igarashi |
| 5,524,695 | A | | 6/1996 | Schwartz |
| 5,569,320 | A | | 10/1996 | Sasaki et al. |
| 5,611,848 | A | | 3/1997 | Sasaki et al. |
| 5,664,628 | A | | 9/1997 | Koehler et al. |
| 5,679,270 | A | | 10/1997 | Thornton et al. |
| 5,738,493 | A | | 4/1998 | Lee et al. |
| 5,778,963 | A | | 7/1998 | Parille et al. |
| 5,810,552 | A | | 9/1998 | Frasier |
| 5,820,774 | A | | 10/1998 | Dietrich |
| 5,909,773 | A | | 6/1999 | Koehler et al. |
| 5,924,483 | A | | 7/1999 | Frasier |
| 5,927,373 | A | | 7/1999 | Tobin |
| 5,947,181 | A | | 9/1999 | Davis |
| 5,951,256 | A | | 9/1999 | Dietrich |
| 5,976,457 | A | | 11/1999 | Amaya et al. |
| 6,029,736 | A | | 2/2000 | Naik et al. |
| 6,039,763 | A | | 3/2000 | Shelokov |
| 6,041,679 | A | | 3/2000 | Slater et al. |
| 6,068,806 | A | | 5/2000 | Dietrich |
| 6,186,741 | B1 | | 2/2001 | Webb et al. |
| 6,221,289 | B1 | | 4/2001 | Corbett et al. |
| 6,234,753 | B1 | | 5/2001 | Lee |
| 6,244,327 | B1 | | 6/2001 | Frasier |
| 6,251,526 | B1 | | 6/2001 | Staub |
| 6,327,943 | B1 | | 12/2001 | Wrigley et al. |
| 6,359,254 | B1 | | 3/2002 | Brown |
| 6,441,341 | B1 | | 8/2002 | Steibel et al. |
| 6,467,534 | B1 | | 10/2002 | Klug et al. |
| 6,474,348 | B1 | | 11/2002 | Beggs et al. |
| 6,505,678 | B2 | | 1/2003 | Mertins |
| 6,557,621 | B1 | | 5/2003 | Dierksmeier et al. |
| 6,578,623 | B2 | | 6/2003 | Keller et al. |
| 6,605,293 | B1 | | 8/2003 | Giordano et al. |
| 6,615,470 | B2 | | 9/2003 | Corderman et al. |
| 6,623,521 | B2 | | 9/2003 | Steinke et al. |
| 6,626,230 | B1 | | 9/2003 | Woodrum et al. |
| 6,634,858 | B2 | | 10/2003 | Roeloffs et al. |
| 6,637,500 | B2 | | 10/2003 | Shah et al. |
| 6,644,921 | B2 | | 11/2003 | Bunker et al. |
| 6,670,026 | B2 | | 12/2003 | Steibel et al. |
| 6,694,731 | B2 | | 2/2004 | Kamen et al. |
| 6,773,231 | B2 | | 8/2004 | Bunker et al. |
| 6,799,627 | B2 | | 10/2004 | Ray et al. |
| 6,800,234 | B2 | | 10/2004 | Ferguson et al. |
| 6,817,379 | B2 | | 11/2004 | Perla |
| 6,837,417 | B2 | | 1/2005 | Srinivasan |
| 6,896,036 | B2 | | 5/2005 | Schneiders et al. |
| 6,913,064 | B2 | | 7/2005 | Beals et al. |
| 6,929,054 | B2 | | 8/2005 | Beals et al. |
| 6,955,522 | B2 | | 10/2005 | Cunha et al. |
| 6,986,381 | B2 | | 1/2006 | Ray et al. |
| 7,028,747 | B2 | | 4/2006 | Widrig et al. |
| 7,036,556 | B2 | | 5/2006 | Caputo et al. |
| 7,052,710 | B2 | | 5/2006 | Giordano et al. |
| 7,073,561 | B1 | | 7/2006 | Henn |
| 7,093,645 | B2 | | 8/2006 | Grunstra et al. |
| 7,108,045 | B2 | | 9/2006 | Wiedemer et al. |
| 7,109,822 | B2 | | 9/2006 | Perkins et al. |
| 7,174,945 | B2 | | 2/2007 | Beals et al. |
| 7,185,695 | B1 | | 3/2007 | Santeler |
| 7,207,375 | B2 | | 4/2007 | Turkington et al. |
| 7,234,506 | B2 | | 6/2007 | Grunstra et al. |
| 7,237,375 | B2 | | 7/2007 | Humcke et al. |
| 7,237,595 | B2 | | 7/2007 | Beck et al. |
| 7,240,718 | B2 | | 7/2007 | Schmidt et al. |
| 7,243,700 | B2 | | 7/2007 | Beals et al. |
| 7,246,652 | B2 | | 7/2007 | Fowler |
| 7,270,170 | B2 | | 9/2007 | Beals et al. |
| 7,270,173 | B2 | | 9/2007 | Wiedemer et al. |
| 7,278,460 | B2 | | 10/2007 | Grunstra et al. |
| 7,278,463 | B2 | | 10/2007 | Snyder et al. |
| 7,306,026 | B2 | | 12/2007 | Memmen |
| 7,322,795 | B2 | | 1/2008 | Luczak et al. |

(56) References Cited

U.S. PATENT DOCUMENTS 7,325,587 B2 2/2008 Memmen
7,334,625 B2 2/2008 Judge et al.
7,343,730 B2 3/2008 Humcke et al.
7,371,043 B2 5/2008 Keller
7,371,049 B2 5/2008 Cunha et al.
7,377,746 B2 5/2008 Brassfield et al.
7,410,342 B2 8/2008 Matheny
7,438,118 B2 10/2008 Santeler
7,448,433 B2 11/2008 Ortiz et al.
7,448,434 B2 11/2008 Turkington et al.
7,461,684 B2 12/2008 Liu et al.
7,478,994 B2 1/2009 Cunha et al.
7,517,225 B2 4/2009 Cherian
7,575,039 B2 8/2009 Beals et al.
7,588,069 B2 9/2009 Munz et al.
7,624,787 B2 12/2009 Lee et al.
7,625,172 B2 12/2009 Walz et al.
7,673,669 B2 3/2010 Snyder et al.
7,686,065 B2 3/2010 Luczak
7,713,029 B1 5/2010 Davies
7,717,676 B2 5/2010 Cunha et al.
7,722,327 B1 5/2010 Liang
7,802,613 B2 5/2010 Bullied et al.
7,727,495 B2 6/2010 Burd et al.
7,731,481 B2 6/2010 Cunha et al.
7,753,104 B2 7/2010 Luczak et al.
7,757,745 B2 7/2010 Luczak
7,771,210 B2 8/2010 Cherian
7,779,892 B2 8/2010 Luczak et al.
7,789,626 B1 9/2010 Liang
7,798,201 B2 9/2010 Bewlay et al.
7,806,681 B2 10/2010 Fieck et al.
7,861,766 B2 1/2011 Bochiechio et al.
7,882,884 B2 2/2011 Beals et al.
7,938,168 B2 5/2011 Lee et al.
7,947,233 B2 5/2011 Burd et al.
7,963,085 B2 6/2011 Sypeck et al.
7,993,106 B2 8/2011 Walters
8,057,183 B1 11/2011 Liang
8,066,483 B1 11/2011 Liang
8,100,165 B2 1/2012 Piggush et al.
8,113,780 B2 2/2012 Cherolis et al.
8,122,583 B2 2/2012 Luczak et al.
8,137,068 B2 3/2012 Surace et al.
8,162,609 B1 4/2012 Liang
8,167,537 B1 5/2012 Plank et al.
8,171,978 B2 5/2012 Propheter-Hinckley et al.
8,181,692 B2 5/2012 Frasier et al.
8,196,640 B1 6/2012 Paulus et al.
8,251,123 B2 8/2012 Farris et al.
8,251,660 B1 8/2012 Liang
8,261,810 B1 9/2012 Liang
8,291,963 B1 10/2012 Trinks et al.
8,297,455 B2 10/2012 Smyth
8,302,668 B1 11/2012 Bullied et al.
8,303,253 B1 11/2012 Liang
8,307,654 B1 11/2012 Liang
8,317,475 B1 11/2012 Downs
8,322,988 B1 12/2012 Downs et al.
8,336,606 B2 12/2012 Piggush
8,342,802 B1 1/2013 Liang
8,366,394 B1 2/2013 Liang
8,381,923 B2 2/2013 Smyth
8,414,263 B1 4/2013 Liang
8,500,401 B1 8/2013 Liang
8,506,256 B1 8/2013 Brostmeyer et al.
8,535,004 B2 9/2013 Campbell
8,622,113 B1 1/2014 Rau, III
8,678,766 B1 3/2014 Liang
8,734,108 B1 5/2014 Liang
8,753,083 B2 6/2014 Lacy et al.
8,770,931 B2 7/2014 Alvanos et al.
8,777,571 B1 7/2014 Liang
8,793,871 B2 8/2014 Morrison et al.
8,794,298 B2 8/2014 Schlienger et al.
8,807,943 B1 8/2014 Liang
8,813,812 B2 8/2014 Ellgass et al.
8,813,824 B2 8/2014 Appleby et al.
8,858,176 B1 10/2014 Liang
8,864,469 B1 10/2014 Liang
8,870,524 B1 10/2014 Liang
8,876,475 B1 11/2014 Liang
8,893,767 B2 11/2014 Mueller et al.
8,899,303 B2 12/2014 Mueller et al.
8,906,170 B2 12/2014 Gigliotti, Jr. et al.
8,911,208 B2 12/2014 Propheter-Hinckley et al.
8,915,289 B2 12/2014 Mueller et al.
8,936,068 B2 1/2015 Lee et al.
8,940,114 B2 1/2015 James et al.
8,969,760 B2 3/2015 Hu et al.
8,978,385 B2 3/2015 Cunha
8,993,923 B2 3/2015 Hu et al.
8,997,836 B2 4/2015 Mueller et al.
9,038,706 B2 5/2015 Hillier
9,051,838 B2 6/2015 Wardle et al.
9,057,277 B2 6/2015 Appleby et al.
9,057,523 B2 6/2015 Cunha et al.
9,061,350 B2 6/2015 Bewlay et al.
9,079,241 B2 7/2015 Barber et al.
9,079,803 B2 7/2015 Xu
9,174,271 B2 11/2015 Newton et al.
9,579,714 B1 2/2017 Rutkowski
2001/0044651 A1 11/2001 Steinke et al.
2002/0029567 A1 3/2002 Kamen et al.
2002/0182056 A1 12/2002 Widrig et al.
2002/0187065 A1 12/2002 Amaya et al.
2002/0190039 A1 12/2002 Steibel et al.
2002/0197161 A1 12/2002 Roeloffs et al.
2003/0047197 A1 3/2003 Beggs et al.
2003/0062088 A1 4/2003 Perla
2003/0133799 A1 7/2003 Widrig et al.
2003/0150092 A1 8/2003 Corderman et al.
2003/0199969 A1 10/2003 Steinke et al.
2003/0201087 A1 10/2003 Devine et al.
2004/0024470 A1 2/2004 Giordano et al.
2004/0055725 A1 3/2004 Ray et al.
2004/0056079 A1 3/2004 Srinivasan
2004/0144089 A1 7/2004 Kamen et al.
2004/0154252 A1 8/2004 Sypeck et al.
2004/0159985 A1 8/2004 Altoonian et al.
2005/0006047 A1 1/2005 Wang et al.
2005/0016706 A1 1/2005 Ray et al.
2005/0087319 A1 4/2005 Beals et al.
2005/0133193 A1 6/2005 Beals et al.
2005/0247429 A1 11/2005 Turkington et al.
2006/0032604 A1 2/2006 Beck et al.
2006/0048553 A1 3/2006 Almquist
2006/0065383 A1 3/2006 Ortiz et al.
2006/0107668 A1 5/2006 Cunha et al.
2006/0118262 A1 6/2006 Beals et al.
2006/0118990 A1 6/2006 Dierkes et al.
2006/0237163 A1 10/2006 Turkington et al.
2006/0283168 A1 12/2006 Humcke et al.
2007/0044936 A1 3/2007 Memmen
2007/0059171 A1 3/2007 Simms et al.
2007/0107412 A1 5/2007 Humcke et al.
2007/0114001 A1 5/2007 Snyder et al.
2007/0116972 A1 5/2007 Persky
2007/0169605 A1 7/2007 Szymanski
2007/0177975 A1 8/2007 Luczak et al.
2007/0253816 A1 11/2007 Walz et al.
2008/0003849 A1 1/2008 Cherian
2008/0080979 A1 4/2008 Brassfield et al.
2008/0131285 A1 6/2008 Albert et al.
2008/0135718 A1 6/2008 Lee et al.
2008/0138208 A1 6/2008 Walters
2008/0138209 A1 6/2008 Cunha et al.
2008/0145235 A1 6/2008 Cunha et al.
2008/0169412 A1 7/2008 Snyder et al.
2008/0190582 A1 8/2008 Lee et al.
2009/0041587 A1 2/2009 Konter et al.
2009/0095435 A1 4/2009 Luczak et al.
2009/0181560 A1 7/2009 Cherian
2009/0255742 A1 10/2009 Hansen

(56) References Cited

U.S. PATENT DOCUMENTS

| | | | |
|---|---|---|---|
| 2010/0021643 | A1 | 1/2010 | Lane et al. |
| 2010/0150733 | A1 | 6/2010 | Abdel-Messeh et al. |
| 2010/0200189 | A1 | 8/2010 | Qi et al. |
| 2010/0219325 | A1 | 9/2010 | Bullied et al. |
| 2010/0276103 | A1 | 11/2010 | Bullied et al. |
| 2010/0304064 | A1 | 12/2010 | Huttner |
| 2011/0048665 | A1 | 3/2011 | Schlienger et al. |
| 2011/0068077 | A1 | 3/2011 | Smyth |
| 2011/0132563 | A1 | 6/2011 | Merrill et al. |
| 2011/0132564 | A1 | 6/2011 | Merrill et al. |
| 2011/0135446 | A1 | 6/2011 | Dube et al. |
| 2011/0146075 | A1 | 6/2011 | Hazel et al. |
| 2011/0150666 | A1 | 6/2011 | Hazel et al. |
| 2011/0189440 | A1 | 8/2011 | Appleby et al. |
| 2011/0236221 | A1 | 9/2011 | Campbell |
| 2011/0240245 | A1 | 10/2011 | Schlienger et al. |
| 2011/0250078 | A1 | 10/2011 | Bruce et al. |
| 2011/0250385 | A1 | 10/2011 | Sypeck et al. |
| 2011/0293434 | A1 | 12/2011 | Lee et al. |
| 2011/0315337 | A1 | 12/2011 | Piggush |
| 2012/0161498 | A1 | 6/2012 | Hansen |
| 2012/0163995 | A1 | 6/2012 | Wardle et al. |
| 2012/0168108 | A1 | 7/2012 | Farris et al. |
| 2012/0183412 | A1 | 7/2012 | Lacy et al. |
| 2012/0186681 | A1 | 7/2012 | Sun et al. |
| 2012/0186768 | A1 | 7/2012 | Sun et al. |
| 2012/0193841 | A1 | 8/2012 | Wang et al. |
| 2012/0237786 | A1 | 9/2012 | Morrison et al. |
| 2012/0276361 | A1 | 11/2012 | James et al. |
| 2012/0298321 | A1 | 11/2012 | Smyth |
| 2013/0019604 | A1 | 1/2013 | Cunha et al. |
| 2013/0025287 | A1 | 1/2013 | Cunha |
| 2013/0025288 | A1 | 1/2013 | Cunha et al. |
| 2013/0064676 | A1 | 3/2013 | Salisbury et al. |
| 2013/0139990 | A1 | 6/2013 | Appleby et al. |
| 2013/0177448 | A1 | 7/2013 | Spangler |
| 2013/0220571 | A1 | 8/2013 | Mueller et al. |
| 2013/0266816 | A1 | 10/2013 | Xu |
| 2013/0280093 | A1 | 10/2013 | Zelesky et al. |
| 2013/0318771 | A1 | 12/2013 | Luczak et al. |
| 2013/0323033 | A1 | 12/2013 | Lutjen et al. |
| 2013/0327602 | A1 | 12/2013 | Barber et al. |
| 2013/0333855 | A1 | 12/2013 | Merrill et al. |
| 2013/0338267 | A1 | 12/2013 | Appleby et al. |
| 2014/0023497 | A1 | 1/2014 | Giglio et al. |
| 2014/0031458 | A1 | 1/2014 | Jansen |
| 2014/0033736 | A1 | 2/2014 | Propheter-Hinckley et al. |
| 2014/0068939 | A1 | 3/2014 | Devine, II et al. |
| 2014/0076857 | A1 | 3/2014 | Hu et al. |
| 2014/0076868 | A1 | 3/2014 | Hu et al. |
| 2014/0093387 | A1 | 4/2014 | Pointon et al. |
| 2014/0140860 | A1 | 5/2014 | Tibbott et al. |
| 2014/0169981 | A1 | 6/2014 | Bales et al. |
| 2014/0199177 | A1 | 7/2014 | Propheter-Hinckley et al. |
| 2014/0202650 | A1 | 7/2014 | Song et al. |
| 2014/0284016 | A1 | 9/2014 | Vander Wal |
| 2014/0311315 | A1 | 10/2014 | Isaac |
| 2014/0314581 | A1 | 10/2014 | McBrien et al. |
| 2014/0342175 | A1 | 11/2014 | Morrison et al. |
| 2014/0342176 | A1 | 11/2014 | Appleby et al. |
| 2014/0356560 | A1 | 12/2014 | Prete et al. |
| 2014/0363305 | A1 | 12/2014 | Shah et al. |
| 2015/0053365 | A1 | 2/2015 | Mueller et al. |
| 2015/0174653 | A1 | 6/2015 | Verner et al. |
| 2015/0184857 | A1 | 7/2015 | Cunha et al. |
| 2015/0306657 | A1 | 10/2015 | Frank |

FOREIGN PATENT DOCUMENTS

| | | | |
|---|---|---|---|
| EP | 0025481 | B1 | 2/1983 |
| EP | 0111600 | A1 | 6/1984 |
| EP | 0190114 | A1 | 8/1986 |
| EP | 0319244 | A2 | 6/1989 |
| EP | 0324229 | A2 | 7/1989 |
| EP | 0324229 | B1 | 7/1992 |
| EP | 0539317 | A1 | 4/1993 |
| EP | 0556946 | A1 | 8/1993 |
| EP | 0559251 | A1 | 9/1993 |
| EP | 0585183 | A1 | 3/1994 |
| EP | 0319244 | B1 | 5/1994 |
| EP | 0661246 | A1 | 7/1995 |
| EP | 0539317 | B1 | 11/1995 |
| EP | 0715913 | A1 | 6/1996 |
| EP | 0725606 | A1 | 8/1996 |
| EP | 0750956 | A2 | 1/1997 |
| EP | 0750957 | A1 | 1/1997 |
| EP | 0792409 | A1 | 9/1997 |
| EP | 0691894 | B1 | 10/1997 |
| EP | 0805729 | A2 | 11/1997 |
| EP | 0818256 | A1 | 1/1998 |
| EP | 0556946 | B1 | 4/1998 |
| EP | 0559251 | B1 | 12/1998 |
| EP | 0585183 | B1 | 3/1999 |
| EP | 0899039 | A2 | 3/1999 |
| EP | 0750956 | B1 | 5/1999 |
| EP | 0661246 | B1 | 9/1999 |
| EP | 0725606 | B1 | 12/1999 |
| EP | 0968062 | A1 | 1/2000 |
| EP | 0805729 | B1 | 8/2000 |
| EP | 1055800 | A2 | 11/2000 |
| EP | 1070829 | A2 | 1/2001 |
| EP | 1124509 | A1 | 8/2001 |
| EP | 1142658 | A1 | 10/2001 |
| EP | 1161307 | A1 | 12/2001 |
| EP | 1163970 | A1 | 12/2001 |
| EP | 1178769 | A1 | 2/2002 |
| EP | 0715913 | B1 | 4/2002 |
| EP | 0968062 | B1 | 5/2002 |
| EP | 0951579 | B1 | 1/2003 |
| EP | 1284338 | A2 | 2/2003 |
| EP | 0750957 | B1 | 3/2003 |
| EP | 1341481 | A2 | 9/2003 |
| EP | 1358958 | A1 | 11/2003 |
| EP | 1367224 | A1 | 12/2003 |
| EP | 0818256 | B1 | 2/2004 |
| EP | 1124509 | B1 | 3/2004 |
| EP | 1425483 | A2 | 6/2004 |
| EP | 1055800 | B1 | 10/2004 |
| EP | 1163970 | B1 | 3/2005 |
| EP | 1358958 | B1 | 3/2005 |
| EP | 1519116 | A1 | 3/2005 |
| EP | 1531019 | A1 | 5/2005 |
| EP | 0899039 | B1 | 11/2005 |
| EP | 1604753 | A1 | 12/2005 |
| EP | 1659264 | A2 | 5/2006 |
| EP | 1178769 | B1 | 7/2006 |
| EP | 1382403 | B1 | 9/2006 |
| EP | 1759788 | A2 | 3/2007 |
| EP | 1764171 | A1 | 3/2007 |
| EP | 1813775 | A2 | 8/2007 |
| EP | 1815923 | A1 | 8/2007 |
| EP | 1849965 | A2 | 10/2007 |
| EP | 1070829 | B1 | 1/2008 |
| EP | 1142658 | B1 | 3/2008 |
| EP | 1927414 | A2 | 6/2008 |
| EP | 1930097 | A1 | 6/2008 |
| EP | 1930098 | A1 | 6/2008 |
| EP | 1930099 | A1 | 6/2008 |
| EP | 1932604 | A1 | 6/2008 |
| EP | 1936118 | A2 | 6/2008 |
| EP | 1939400 | A2 | 7/2008 |
| EP | 1984162 | A1 | 10/2008 |
| EP | 1604753 | B1 | 11/2008 |
| EP | 2000234 | A2 | 12/2008 |
| EP | 2025869 | A1 | 2/2009 |
| EP | 1531019 | B1 | 3/2010 |
| EP | 2212040 | A1 | 8/2010 |
| EP | 2246133 | A1 | 11/2010 |
| EP | 2025869 | B1 | 12/2010 |
| EP | 2335845 | A1 | 6/2011 |
| EP | 2336493 | A2 | 6/2011 |
| EP | 2336494 | A2 | 6/2011 |
| EP | 1930097 | B1 | 7/2011 |
| EP | 2362822 | A2 | 9/2011 |

(56) References Cited

FOREIGN PATENT DOCUMENTS

| | | | |
|---|---|---|---|
| EP | 2366476 | A1 | 9/2011 |
| EP | 2392774 | A1 | 12/2011 |
| EP | 1930098 | B1 | 2/2012 |
| EP | 2445668 | A2 | 5/2012 |
| EP | 2445669 | A2 | 5/2012 |
| EP | 2461922 | A1 | 6/2012 |
| EP | 1659264 | B1 | 11/2012 |
| EP | 2519367 | A2 | 11/2012 |
| EP | 2537606 | A1 | 12/2012 |
| EP | 1927414 | B1 | 1/2013 |
| EP | 2549186 | A2 | 1/2013 |
| EP | 2551592 | A2 | 1/2013 |
| EP | 2551593 | A2 | 1/2013 |
| EP | 2559533 | A2 | 2/2013 |
| EP | 2559534 | A2 | 2/2013 |
| EP | 2559535 | A2 | 2/2013 |
| EP | 2576099 | A1 | 4/2013 |
| EP | 2000234 | B1 | 7/2013 |
| EP | 2614902 | A2 | 7/2013 |
| EP | 2650062 | A2 | 10/2013 |
| EP | 2246133 | B1 | 7/2014 |
| EP | 2366476 | B1 | 7/2014 |
| EP | 2777841 | A1 | 9/2014 |
| EP | 1849965 | B1 | 2/2015 |
| EP | 2834031 | A2 | 2/2015 |
| EP | 1341481 | B1 | 3/2015 |
| EP | 2841710 | A1 | 3/2015 |
| EP | 2855857 | A2 | 4/2015 |
| EP | 2880276 | A1 | 6/2015 |
| EP | 2937161 | A1 | 10/2015 |
| GB | 731292 | A | 6/1955 |
| GB | 800228 | A | 8/1958 |
| GB | 2102317 | A | 2/1983 |
| GB | 2118078 | A | 10/1983 |
| JP | H1052731 | A | 2/1998 |
| WO | 9615866 | A1 | 5/1996 |
| WO | 9618022 | A1 | 6/1996 |
| WO | 2010036801 | A2 | 4/2010 |
| WO | 2010040746 | A1 | 4/2010 |
| WO | 2010151833 | A2 | 12/2010 |
| WO | 2010151838 | A2 | 12/2010 |
| WO | 2011019667 | A1 | 2/2011 |
| WO | 2013163020 | A1 | 10/2013 |
| WO | 2014011262 | A2 | 1/2014 |
| WO | 2014022255 | A1 | 2/2014 |
| WO | 2014028095 | A2 | 2/2014 |
| WO | 2014093826 | A2 | 6/2014 |
| WO | 2014105108 | A1 | 7/2014 |
| WO | 2014109819 | A1 | 7/2014 |
| WO | 2014133635 | A2 | 9/2014 |
| WO | 2014179381 | A1 | 11/2014 |
| WO | 2015006026 | A1 | 1/2015 |
| WO | 2015006440 | A1 | 1/2015 |
| WO | 2015006479 | A1 | 1/2015 |
| WO | 2015009448 | A1 | 1/2015 |
| WO | 2015042089 | A1 | 3/2015 |
| WO | 2015050987 | A1 | 4/2015 |
| WO | 2015053833 | A1 | 4/2015 |
| WO | 2015073068 | A1 | 5/2015 |
| WO | 2015073657 | A1 | 5/2015 |
| WO | 2015080854 | A1 | 6/2015 |
| WO | 2015094636 | A1 | 6/2015 |

OTHER PUBLICATIONS

Liu et al, "Effect of nickel coating on bending properties of stereolithography photo-polymer SL5195", Materials & Design, vol. 26, Issue 6, pp. 493-496, 2005.

European Search Report and Opinion issued in connection with related EP Application No. 16202422.8 dated May 8, 2017, 6 pp.

European Search Report and Opinion issued in connection with related EP Application No. 162046023 dated May 12, 2017, 8 pp.

European Search Report and Opinion issued in connection with related EP Application No. 16204609.8 dated May 12, 2017, 8 pp.

European Search Report and Opinion issued in connection with related EP Application No. 16204610.6 dated May 17, 2017, 5 pp.

European Search Report and Opinion issued in connection with related EP Application No. 16204613.0 dated May 22, 2017, 8 pp.

European Search Report and Opinion issued in connection with related EP Application No. 16204605.6 dated May 26, 2017, 9 pp.

European Search Report and Opinion issued in connection with related EP Application No. 16204607.2 dated May 26, 2017, 7 pp.

European Search Report and Opinion issued in connection with related EP Application No. 16204608.0 dated May 26, 2017, 7 pp.

European Search Report and Opinion issued in connection with related EP Application No. 16204617.1 dated May 26, 2017, 7 pp.

European Search Report and Opinion issued in connection with corresponding EP Application No. 16204614.8.0 dated Jun. 2, 2017, 7 pp.

European Search Report and Opinion issued in connection with corresponding EP Application No. 17168418.6 dated Aug. 10, 2017, 6 pp.

* cited by examiner

METHOD AND ASSEMBLY FOR FORMING COMPONENTS HAVING INTERNAL PASSAGES USING A LATTICE STRUCTURE

CROSS REFERENCE TO RELATED APPLICATIONS

This application is a divisional application and claims priority to U.S. patent application Ser. No. 14/973,039, filed Dec. 17, 2015, for "METHOD AND ASSEMBLY FOR FORMING COMPONENTS HAVING INTERNAL PASSAGES USING A LATTICE STRUCTURE," which is hereby incorporated by reference in its entirety.

BACKGROUND

The field of the disclosure relates generally to components having an internal passage defined therein, and more particularly to mold assemblies and methods for forming such components using a lattice structure to position a core that defines the internal passage.

Some components require an internal passage to be defined therein, for example, in order to perform an intended function. For example, but not by way of limitation, some components, such as hot gas path components of gas turbines, are subjected to high temperatures. At least some such components have internal passages defined therein to receive a flow of a cooling fluid, such that the components are better able to withstand the high temperatures. For another example, but not by way of limitation, some components are subjected to friction at an interface with another component. At least some such components have internal passages defined therein to receive a flow of a lubricant to facilitate reducing the friction.

At least some known components having an internal passage defined therein are formed in a mold, with a core of ceramic material extending within the mold cavity at a location selected for the internal passage. After a molten metal alloy is introduced into the mold cavity around the ceramic core and cooled to form the component, the ceramic core is removed, such as by chemical leaching, to form the internal passage. However, at least some known cores are difficult to position precisely with respect to the mold cavity, resulting in a decreased yield rate for formed components. For example, some molds used to form such components are formed by investment casting, in which a material, such as, but not limited to, wax, is used to form a pattern of the component for the investment casting process, and at least some known cores are difficult to position precisely with respect to a cavity of a master die used to form the pattern. Moreover, at least some known ceramic cores are fragile, resulting in cores that are difficult and expensive to produce and handle without damage. For example, at least some known ceramic cores lack sufficient strength to reliably withstand injection of the pattern material to form the pattern, repeated dipping of the pattern to form the mold, and/or introduction of the molten metal alloy.

Alternatively or additionally, at least some known components having an internal passage defined therein are initially formed without the internal passage, and the internal passage is formed in a subsequent process. For example, at least some known internal passages are formed by drilling the passage into the component, such as, but not limited to, using an electrochemical drilling process. However, at least some such drilling processes are relatively time-consuming and expensive. Moreover, at least some such drilling processes cannot produce an internal passage curvature required for certain component designs.

BRIEF DESCRIPTION

In one aspect, a mold assembly for use in forming a component having an internal passage defined therein is provided. The component is formed from a component material. The mold assembly includes a mold that defines a mold cavity therein. The mold assembly also includes a lattice structure selectively positioned at least partially within the mold cavity. The lattice structure is formed from a first material that is at least partially absorbable by the component material in a molten state. A channel is defined through the lattice structure, and a core is positioned in the channel such that at least a portion of the core extends within the mold cavity and defines the internal passage when the component is formed in the mold assembly.

In another aspect, a method of forming a component having an internal passage defined therein is provided. The method includes selectively positioning a lattice structure at least partially within a cavity of a mold. The lattice structure is formed from a first material. A core is positioned in a channel defined through the lattice structure, such that at least a portion of the core extends within the mold cavity. The method also includes introducing a component material in a molten state into the cavity, such that the component material in the molten state at least partially absorbs the first material from the lattice structure. The method further includes cooling the component material in the cavity to form the component. At least the portion of the core defines the internal passage within the component.

DRAWINGS

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms such as "about," "approximately," and "substantially" is not to be limited to the precise value specified. In at least some instances, the approximating language may correspond to the precision of an instrument for measuring the value. Here and throughout the specification and claims, range limitations may be identified. Such ranges may be combined and/or interchanged, and include all the sub-ranges contained therein unless context or language indicates otherwise.

The exemplary components and methods described herein overcome at least some of the disadvantages associated with known assemblies and methods for forming a component having an internal passage defined therein. The embodiments described herein provide a lattice structure selectively positioned within a mold cavity. A channel is defined through the lattice structure, and a core is positioned in the channel such that at least a portion of the core defines a position of the internal passage within the component when the component is formed in the mold. The lattice structure is formed from a first material selected to be absorbable by a component material introduced into the mold cavity to form the component. Thus, the lattice structure used to position and/or support the core need not be removed from the mold assembly prior to casting the component therein.

Figure 1:
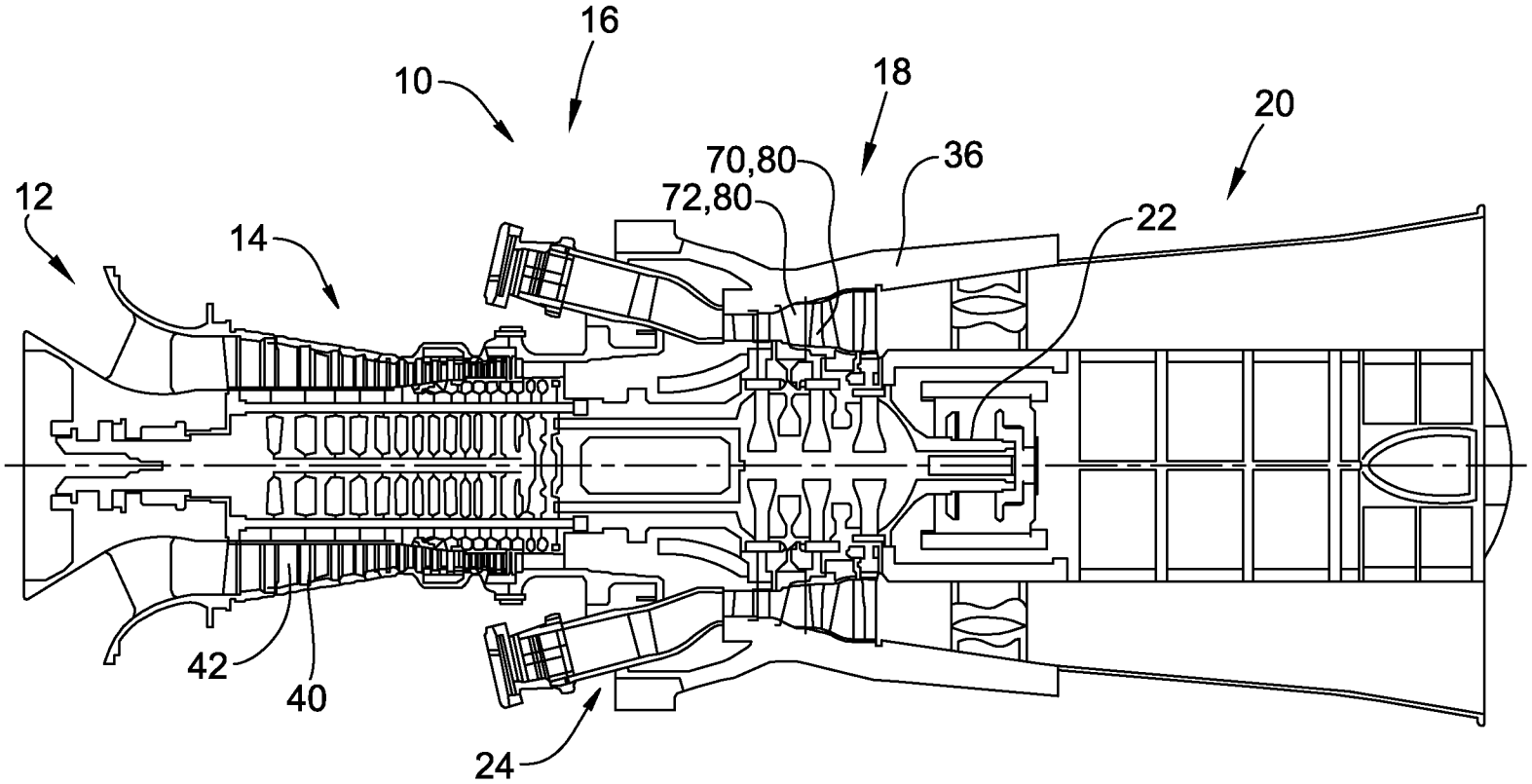
FIG. 1 is a schematic diagram of an exemplary rotary machine.

FIG. 1 is a schematic view of an exemplary rotary machine 10 having components for which embodiments of the current disclosure may be used. In the exemplary embodiment, rotary machine 10 is a gas turbine that includes an intake section 12, a compressor section 14 coupled downstream from intake section 12, a combustor section 16 coupled downstream from compressor section 14, a turbine section 18 coupled downstream from combustor section 16, and an exhaust section 20 coupled downstream from turbine section 18. A generally tubular casing 36 at least partially encloses one or more of intake section 12, compressor section 14, combustor section 16, turbine section 18, and exhaust section 20. In alternative embodiments, rotary machine 10 is any rotary machine for which components formed with internal passages as described herein are suitable. Moreover, although embodiments of the present disclosure are described in the context of a rotary machine for purposes of illustration, it should be understood that the embodiments described herein are applicable in any context that involves a component suitably formed with an internal passage defined therein.

In the exemplary embodiment, turbine section 18 is coupled to compressor section 14 via a rotor shaft 22. It should be noted that, as used herein, the term "couple" is not limited to a direct mechanical, electrical, and/or communication connection between components, but may also include an indirect mechanical, electrical, and/or communication connection between multiple components.

During operation of rotary machine 10, intake section 12 channels air towards compressor section 14. Compressor section 14 compresses the air to a higher pressure and temperature. More specifically, rotor shaft 22 imparts rotational energy to at least one circumferential row of compressor blades 40 coupled to rotor shaft 22 within compressor section 14. In the exemplary embodiment, each row of compressor blades 40 is preceded by a circumferential row of compressor stator vanes 42 extending radially inward from casing 36 that direct the air flow into compressor blades 40. The rotational energy of compressor blades 40 increases a pressure and temperature of the air. Compressor section 14 discharges the compressed air towards combustor section 16.

In combustor section 16, the compressed air is mixed with fuel and ignited to generate combustion gases that are channeled towards turbine section 18. More specifically, combustor section 16 includes at least one combustor 24, in which a fuel, for example, natural gas and/or fuel oil, is injected into the air flow, and the fuel-air mixture is ignited to generate high temperature combustion gases that are channeled towards turbine section 18.

Turbine section 18 converts the thermal energy from the combustion gas stream to mechanical rotational energy. More specifically, the combustion gases impart rotational energy to at least one circumferential row of rotor blades 70 coupled to rotor shaft 22 within turbine section 18. In the exemplary embodiment, each row of rotor blades 70 is preceded by a circumferential row of turbine stator vanes 72 extending radially inward from casing 36 that direct the combustion gases into rotor blades 70. Rotor shaft 22 may be coupled to a load (not shown) such as, but not limited to, an electrical generator and/or a mechanical drive application. The exhausted combustion gases flow downstream from turbine section 18 into exhaust section 20. Components of rotary machine 10 are designated as components 80. Components 80 proximate a path of the combustion gases are subjected to high temperatures during operation of rotary machine 10. Additionally or alternatively, components 80 include any component suitably formed with an internal passage defined therein.

Figure 2:
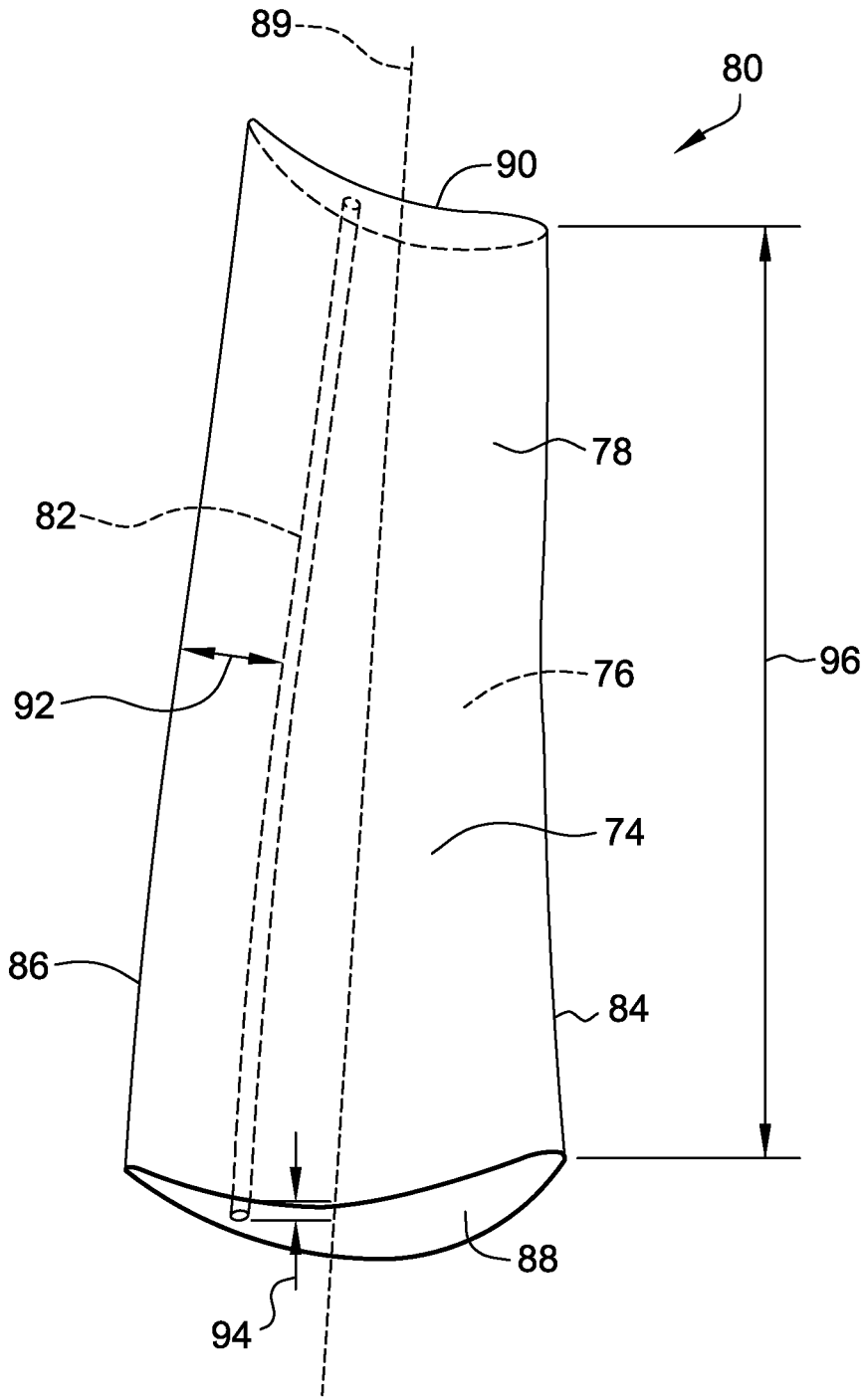
FIG. 2 is a schematic perspective view of an exemplary component for use with the rotary machine shown in FIG. 1.

FIG. 2 is a schematic perspective view of an exemplary component 80, illustrated for use with rotary machine 10 (shown in FIG. 1). Component 80 includes at least one internal passage 82 defined therein. For example, a cooling fluid is provided to internal passage 82 during operation of rotary machine 10 to facilitate maintaining component 80 below a temperature of the hot combustion gases. Although only one internal passage 82 is illustrated, it should be understood that component 80 includes any suitable number of internal passages 82 formed as described herein.

Component 80 is formed from a component material 78. In the exemplary embodiment, component material 78 is a suitable nickel-based superalloy. In alternative embodiments, component material 78 is at least one of a cobalt-based superalloy, an iron-based alloy, and a titanium-based alloy. In other alternative embodiments, component material 78 is any suitable material that enables component 80 to be formed as described herein.

In the exemplary embodiment, component 80 is one of rotor blades 70 or stator vanes 72. In alternative embodiments, component 80 is another suitable component of rotary machine 10 that is capable of being formed with an internal passage as described herein. In still other embodiments, component 80 is any component for any suitable application that is suitably formed with an internal passage defined therein.

In the exemplary embodiment, rotor blade 70, or alternatively stator vane 72, includes a pressure side 74 and an opposite suction side 76. Each of pressure side 74 and suction side 76 extends from a leading edge 84 to an opposite trailing edge 86. In addition, rotor blade 70, or alternatively stator vane 72, extends from a root end 88 to an opposite tip end 90, defining a blade length 96. In alternative embodiments, rotor blade 70, or alternatively stator vane 72, has any suitable configuration that is capable of being formed with an internal passage as described herein.

In certain embodiments, blade length 96 is at least about 25.4 centimeters (cm) (10 inches). Moreover, in some embodiments, blade length 96 is at least about 50.8 cm (20 inches). In particular embodiments, blade length 96 is in a range from about 61 cm (24 inches) to about 101.6 cm (40 inches). In alternative embodiments, blade length 96 is less than about 25.4 cm (10 inches). For example, in some embodiments, blade length 96 is in a range from about 2.54 cm (1 inch) to about 25.4 cm (10 inches). In other alternative embodiments, blade length 96 is greater than about 101.6 cm (40 inches).

In the exemplary embodiment, internal passage 82 extends from root end 88 to tip end 90. In alternative embodiments, internal passage 82 extends within component 80 in any suitable fashion, and to any suitable extent, that enables internal passage 82 to be formed as described herein. In certain embodiments, internal passage 82 is nonlinear. For example, component 80 is formed with a predefined twist along an axis 89 defined between root end 88 and tip end 90, and internal passage 82 has a curved shape complementary to the axial twist. In some embodiments, internal passage 82 is positioned at a substantially constant distance 94 from pressure side 74 along a length of internal passage 82. Alternatively or additionally, a chord of component 80 tapers between root end 88 and tip end 90, and internal passage 82 extends nonlinearly complementary to the taper, such that internal passage 82 is positioned at a substantially constant distance 92 from trailing edge 86 along the length of internal passage 82. In alternative embodiments, internal passage 82 has a nonlinear shape that is complementary to any suitable contour of component 80. In other alternative embodiments, internal passage 82 is nonlinear and other than complementary to a contour of component 80. In some embodiments, internal passage 82 having a nonlinear shape facilitates satisfying a preselected cooling criterion for component 80. In alternative embodiments, internal passage 82 extends linearly.

In some embodiments, internal passage 82 has a substantially circular cross-section. In alternative embodiments, internal passage 82 has a substantially ovoid cross-section. In other alternative embodiments, internal passage 82 has any suitably shaped cross-section that enables internal passage 82 to be formed as described herein. Moreover, in certain embodiments, the shape of the cross-section of internal passage 82 is substantially constant along a length of internal passage 82. In alternative embodiments, the shape of the cross-section of internal passage 82 varies along a length of internal passage 82 in any suitable fashion that enables internal passage 82 to be formed as described herein.

Figure 3:
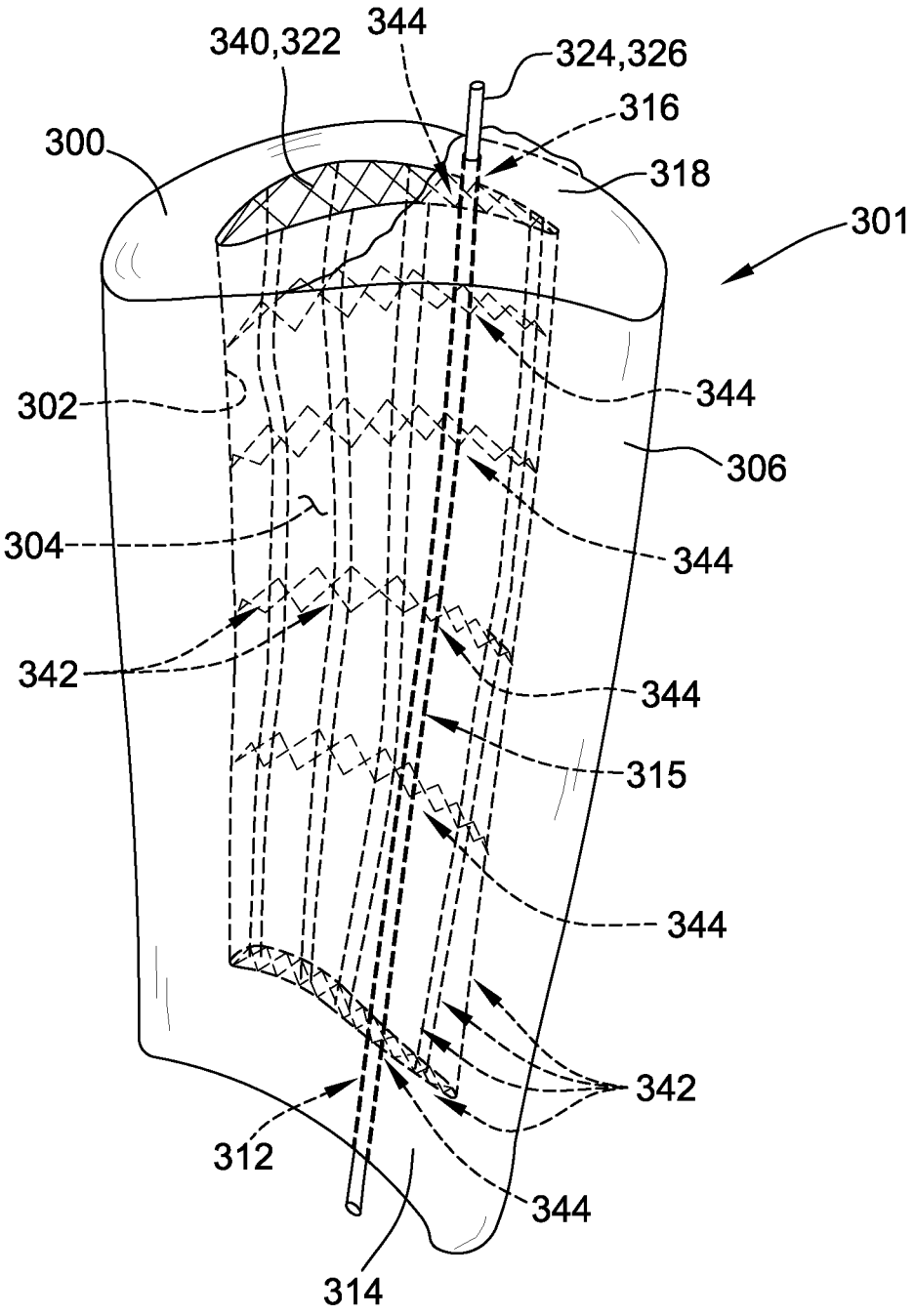
FIG. 3 is a schematic perspective view of an exemplary mold assembly for making the component shown in FIG. 2.
Figure 4:
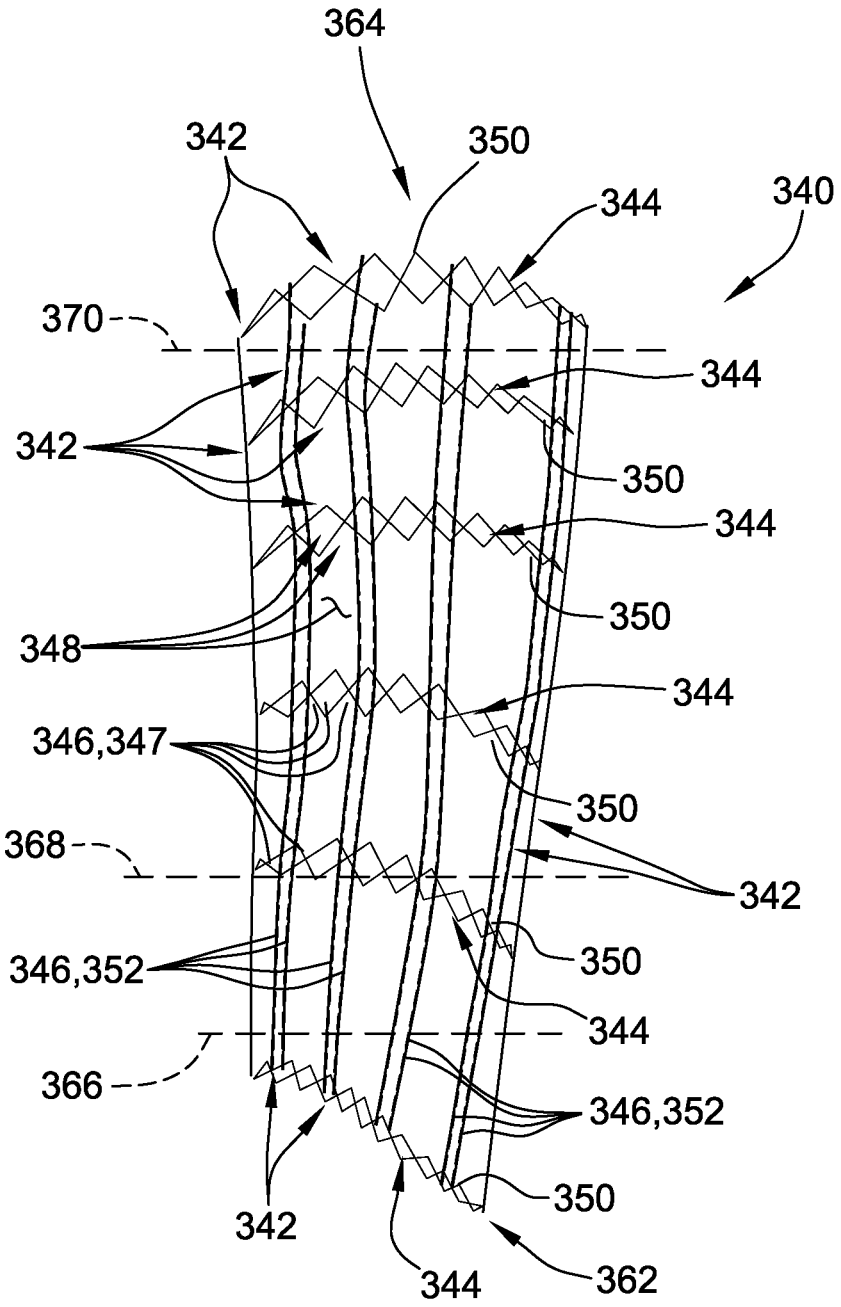
FIG. 4 is a schematic perspective view of an exemplary lattice structure for use with the mold assembly shown in FIG. 3 and with the pattern die assembly shown in FIG. 5.
Figure 5:
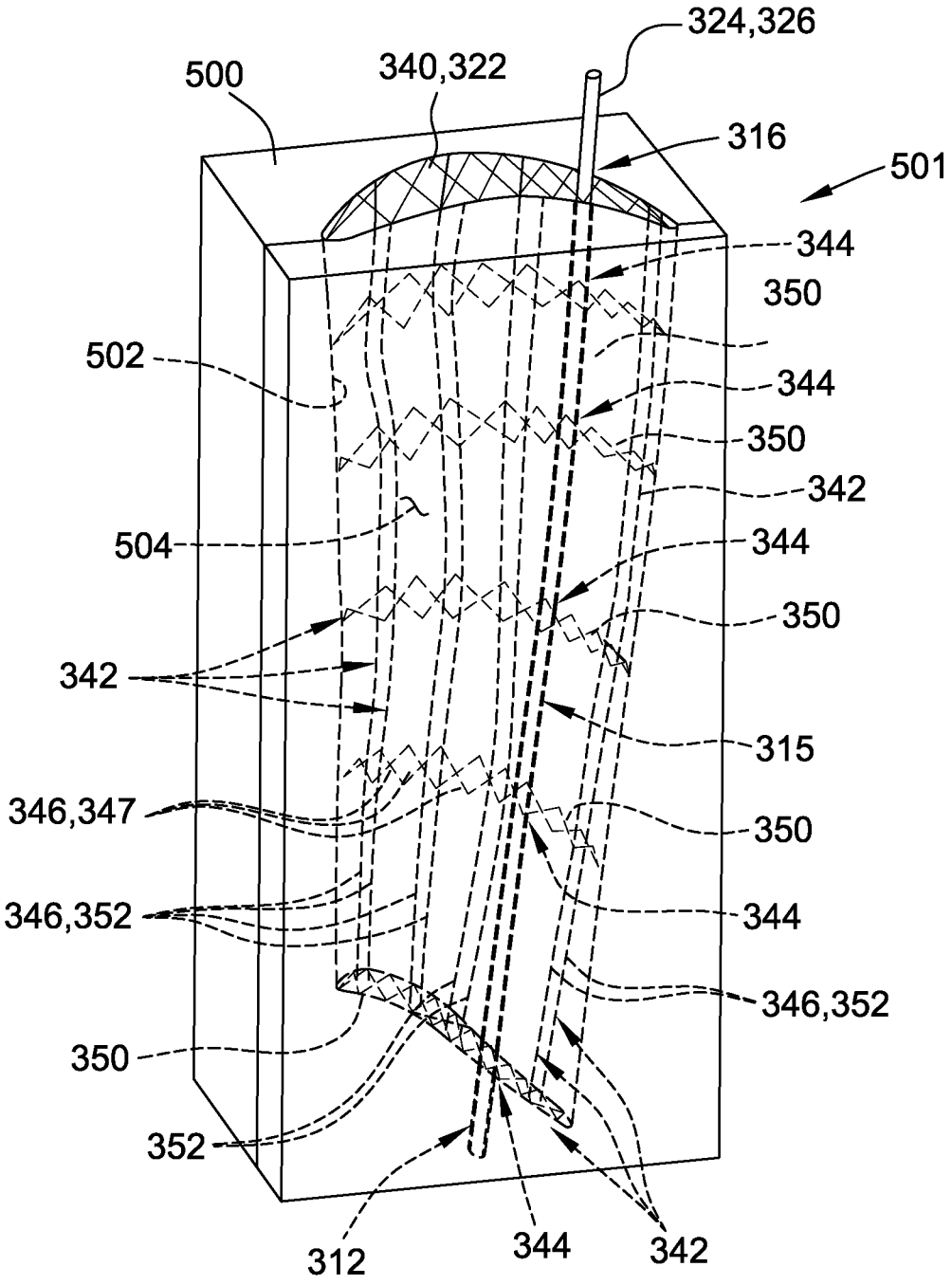
FIG. 5 is a schematic perspective view of an exemplary pattern die assembly for making a pattern of the component shown in FIG. 2, the pattern for use in making the mold assembly shown in FIG. 3.

FIG. 3 is a schematic perspective view of a mold assembly 301 for making component 80 (shown in FIG. 2). Mold assembly 301 includes a lattice structure 340 selectively positioned with respect to a mold 300, and a core 324 received by lattice structure 340. FIG. 4 is a schematic perspective view of lattice structure 340. FIG. 5 is a schematic perspective view of a pattern die assembly 501 for making a pattern (not shown) of component 80 (shown in FIG. 2). Pattern die assembly 501 includes lattice structure 340 selectively positioned with respect to a pattern die 500, and core 324 received by lattice structure 340.

With reference to FIGS. 2 and 5, an interior wall 502 of pattern die 500 defines a die cavity 504. At least a portion of lattice structure 340 is positioned within die cavity 504. Interior wall 502 defines a shape corresponding to an exterior shape of component 80, such that a pattern material (not shown) in a flowable state can be introduced into die cavity 504 and solidified to form a pattern (not shown) of component 80. Core 324 is positioned by lattice structure 340 with respect to pattern die 500 such that a portion 315 of core 324 extends within die cavity 504. Thus, at least a portion of lattice structure 340 and core 324 become encased by the pattern when the pattern is formed in pattern die 500.

In certain embodiments, core 324 is formed from a core material 326. In the exemplary embodiment, core material 326 is a refractory ceramic material selected to withstand a high temperature environment associated with the molten state of component material 78 used to form component 80. For example, but without limitation, inner core material 326 includes at least one of silica, alumina, and mullite. Moreover, in the exemplary embodiment, core material 326 is selectively removable from component 80 to form internal passage 82. For example, but not by way of limitation, core material 326 is removable from component 80 by a suitable process that does not substantially degrade component material 78, such as, but not limited to, a suitable chemical leaching process. In certain embodiments, core material 326 is selected based on a compatibility with, and/or a removability from, component material 78. In alternative embodiments, core material 326 is any suitable material that enables component 80 to be formed as described herein.

Lattice structure 340 is selectively positioned in a preselected orientation within die cavity 504. In addition, a channel 344 is defined through lattice structure 340 and configured to receive core 324, such that portion 315 of core 324 positioned in channel 344 subsequently defines internal passage 82 within component 80 when component 80 is formed in mold 300 (shown in FIG. 3). For example, but not by way of limitation, channel 344 is defined through lattice structure 340 as a series of openings in lattice structure 340 that are aligned to receive core 324.

In certain embodiments, lattice structure 340 defines a perimeter 342 shaped to couple against interior wall 502, such that lattice structure 340 is selectively positioned within die cavity 504. More specifically, perimeter 342 conforms to the shape of interior wall 502 to position and/or maintain lattice structure 340 in the preselected orientation with respect to die cavity 504. Additionally or alternatively, lattice structure 340 is selectively positioned and/or maintained in the preselected orientation within die cavity 504 in any suitable fashion that enables pattern die assembly 501 to function as described herein. For example, but not by way of limitation, lattice structure 340 is securely positioned with respect to die cavity 504 by suitable external fixturing (not shown).

In certain embodiments, lattice structure 340 includes a plurality of interconnected elongated members 346 that define a plurality of open spaces 348 therebetween. Elongated members 346 are arranged to provide lattice structure 340 with a structural strength and stiffness such that, when lattice structure 340 is positioned in the preselected orientation within die cavity 504, channel 344 defined through lattice structure 340 also positions core 324 in the selected orientation to subsequently define the position of internal passage 82 within component 80. In some embodiments, pattern die assembly 501 includes suitable additional structure configured to maintain core 324 in the selected orientation, such as, but not limited to, while the pattern material (not shown) is added to die cavity 504 around lattice structure 340 and core 324.

In the exemplary embodiment, elongated members 346 include sectional elongated members 347. Sectional elongated members 347 are arranged in groups 350 each shaped to be positioned within a corresponding cross-section of die cavity 504. For example, but not by way of limitation, in some embodiments, each group 350 defines a respective cross-sectional portion of perimeter 342 shaped to conform to a corresponding cross-section of die cavity 504 to maintain each group 350 in the preselected orientation. In addition, channel 344 is defined through each group 350 of sectional elongated members 347 as one of a series of openings in lattice structure 340 aligned to receive core 324. Additionally or alternatively, elongated members 346 include stringer elongated members 352. Each stringer elongated member 352 extends between at least two of groups 350 of sectional elongated members 347 to facilitate positioning and/or maintaining each group 350 in the preselected orientation. In some embodiments, stringer elongated members 352 further define perimeter 342 conformal to interior wall 502. Additionally or alternatively, at least one group 350 is coupled to suitable additional structure, such as but not limited to external fixturing, configured to maintain group 350 in the preselected orientation, such as, but not limited to, while the pattern material (not shown) is added to die cavity 504 around core 324.

In alternative embodiments, elongated members 346 are arranged in any suitable fashion that enables lattice structure 340 to function as described herein. For example, elongated members 346 are arranged in a non-uniform and/or non-repeating arrangement. In other alternative embodiments, lattice structure 340 is any suitable structure that enables selective positioning of core 324 as described herein.

In some embodiments, plurality of open spaces 348 is arranged such that each region of lattice structure 340 is in flow communication with substantially each other region of lattice structure 340. Thus, when the flowable pattern material is added to die cavity 504, lattice structure 340 enables the pattern material to flow through and around lattice structure 340 to fill die cavity 504. In alternative embodiments, lattice structure 340 is arranged such that at least one region of lattice structure 340 is not substantially in flow communication with at least one other region of lattice structure 340. For example, but not by way of limitation, the pattern material is injected into die cavity 504 at a plurality of locations to facilitate filling die cavity 504 around lattice structure 340.

With reference to FIGS. 2-5, mold 300 is formed from a mold material 306. In the exemplary embodiment, mold material 306 is a refractory ceramic material selected to withstand a high temperature environment associated with the molten state of component material 78 used to form component 80. In alternative embodiments, mold material 306 is any suitable material that enables component 80 to be formed as described herein. Moreover, in the exemplary embodiment, mold 300 is formed from the pattern made in pattern die 500 by a suitable investment casting process. For example, but not by way of limitation, a suitable pattern material, such as wax, is injected into pattern die 500 around lattice structure 340 and core 324 to form the pattern (not shown) of component 80, the pattern is repeatedly dipped into a slurry of mold material 306 which is allowed to harden to create a shell of mold material 306, and the shell is dewaxed and fired to form mold 300. After dewaxing, because lattice structure 340 and core 324 were at least partially encased in the pattern used to form mold 300, lattice structure 340 and core 324 remain positioned with respect to mold 300 to form mold assembly 301, as described above. In alternative embodiments, mold 300 is formed from the pattern made in pattern die 500 by any suitable method that enables mold 300 to function as described herein.

An interior wall 302 of mold 300 defines mold cavity 304. Because mold 300 is formed from the pattern made in pattern die assembly 501, interior wall 302 defines a shape corresponding to the exterior shape of component 80, such that component material 78 in a molten state can be introduced into mold cavity 304 and cooled to form component 80. It should be recalled that, although component 80 in the exemplary embodiment is rotor blade 70, or alternatively stator vane 72, in alternative embodiments component 80 is any component suitably formable with an internal passage defined therein, as described herein.

In addition, at least a portion of lattice structure 340 is selectively positioned within mold cavity 304. More specifically, lattice structure 340 is positioned in a preselected orientation with respect to mold cavity 304, substantially identical to the preselected orientation of lattice structure 340 with respect to die cavity 504. In addition, core 324 remains positioned in channel 344 defined through lattice structure 340, such that portion 315 of core 324 subsequently defines internal passage 82 within component 80 when component 80 is formed in mold 300 (shown in FIG. 3).

In various embodiments, at least some of the previously described elements of embodiments of lattice structure 340 are positioned with respect to mold cavity 304 in a manner that corresponds to the positioning of those elements described above in corresponding embodiments with respect to die cavity 504 of pattern die 500. For example, it should be understood that, after shelling of the pattern formed in pattern die 500, removal of the pattern material, and firing to form mold assembly 301, each of the previously described elements of embodiments of lattice structure 340 are positioned with respect to mold cavity 304 as they were positioned with respect to die cavity 504 of pattern die 500.

Alternatively, lattice structure 340 and core 324 are not embedded in a pattern used to form mold 300, but rather are subsequently positioned with respect to mold 300 to form mold assembly 301 such that, in various embodiments, perimeter 342, channel 344, elongated members 346, sectional elongated members 347, plurality of open spaces 348, groups 350 of sectional elongated members 347, and/or stringer elongated members 352, are positioned in relationships with respect to interior wall 302 and mold cavity 304 of mold 300 that correspond to the relationships described above with respect to interior wall 502 and die cavity 504.

Thus, in certain embodiments, perimeter 342 is shaped to couple against interior wall 302, such that lattice structure 340 is selectively positioned within mold cavity 304, and more specifically, perimeter 342 conforms to the shape of interior wall 302 to position lattice structure 340 in the preselected orientation with respect to mold cavity 304. Additionally or alternatively, elongated members 346 are arranged to provide lattice structure 340 with a structural strength and stiffness such that, when lattice structure 340 is positioned in the preselected orientation within mold cavity 304, core 324 is maintained in the selected orientation to subsequently define the position of internal passage 82 within component 80. Additionally or alternatively, plurality of open spaces 348 is arranged such that each region of lattice structure 340 is in flow communication with substantially each other region of lattice structure 340. Additionally or alternatively, at least one group 350 of sectional elongated members 347 is shaped to be positioned within a corresponding cross-section of mold cavity 304. For example, but not by way of limitation, in some embodiments each group 350 defines a respective cross-sectional portion of perimeter 342 shaped to conform to a corresponding cross-section of mold cavity 304. In some embodiments, stringer elongated members 352 each extend between at least two of groups 350 of sectional elongated members 347 and, in some such embodiments, facilitate positioning and/or maintaining each group 350 in the preselected orientation. Moreover, in some such embodiments, at least one stringer elongated member 352 further defines perimeter 342 conformal to interior wall 302. Additionally or alternatively, in some embodiments, at least one group 350 is coupled to suitable additional structure, such as but not limited to external fixturing, configured to maintain group 350 in the preselected orientation, such as, but not limited to, while component material 78 in a molten state is added to mold cavity 304 around inner core 324.

In certain embodiments, at least one of lattice structure 340 and core 324 is further secured relative to mold 300 such that core 324 remains fixed relative to mold 300 during a process of forming component 80. For example, at least one of lattice structure 340 and core 324 is further secured to inhibit shifting of lattice structure 340 and core 324 during introduction of molten component material 78 into mold cavity 304 surrounding core 324. In some embodiments, core 324 is coupled directly to mold 300. For example, in the exemplary embodiment, a tip portion 312 of core 324 is rigidly encased in a tip portion 314 of mold 300. Additionally or alternatively, a root portion 316 of core 324 is rigidly encased in a root portion 318 of mold 300 opposite tip portion 314. For example, but not by way of limitation, tip portion 312 and/or root portion 316 extend out of die cavity 504 of pattern die 500, and thus extend out of the pattern formed in pattern die 500, and the investment process causes mold 300 to encase tip portion 312 and/or root portion 316. Additionally or alternatively, lattice structure 340 proximate perimeter 342 is coupled directly to mold 300 in similar fashion. Additionally or alternatively, at least one of lattice structure 340 and core 324 is further secured relative to mold 300 in any other suitable fashion that enables the position of core 324 relative to mold 300 to remain fixed during a process of forming component 80.

In certain embodiments, lattice structure 340 is configured to support core 324 within pattern die assembly 501 and/or mold assembly 301. For example, but not by way of limitation, core material 326 is a relatively brittle ceramic material, and/or core 324 has a nonlinear shape corresponding to a selected nonlinear shape of internal passage 82. More specifically, the nonlinear shape of core 324 tends to subject at least a portion of ceramic core 324 suspended within die cavity 504 and/or mold cavity 304 to tension, increasing the risk of cracking or breaking of ceramic core prior to or during formation of a pattern in pattern die 500, formation of mold assembly 301 (shown in FIG. 3), and/or formation of component 80 within mold 300. Lattice structure 340 is configured to at least partially support a weight of core 324 during pattern forming, investment casting, and/or component forming, thereby decreasing the risk of cracking or breaking of core 324. In alternative embodiments, lattice structure 340 does not substantially support core 324.

Lattice structure 340 is formed from a first material 322 selected to be at least partially absorbable by molten component material 78. In certain embodiments, first material 322 is selected such that, after molten component material 78 is added to mold cavity 304 and first material 322 is at least partially absorbed by molten component material 78, a performance of component material 78 in a subsequent solid state is not degraded. For one example, component 80 is rotor blade 70, and absorption of first material 322 from lattice structure 340 does not substantially reduce a melting point and/or a high-temperature strength of component material 78, such that a performance of rotor blade 70 during operation of rotary machine 10 (shown in FIG. 1) is not degraded.

Because first material 322 is at least partially absorbable by component material 78 in a molten state such that a performance of component material 78 in a solid state is not substantially degraded, lattice structure 340 need not be removed from mold assembly 301 prior to introducing molten component material 78 into mold cavity 304. Thus, as compared to methods that require a positioning structure for core 324 to be mechanically or chemically removed, a use of lattice structure 340 in pattern die assembly 501 to position core 324 with respect to die cavity 504 decreases a number of process steps, and thus reduces a time and a cost, required to form component 80 having internal passage 82.

In some embodiments, component material 78 is an alloy, and first material 322 is at least one constituent material of the alloy. For example, component material 78 is a nickel-based superalloy, and first material 322 is substantially nickel, such that first material 322 is substantially absorbable by component material 78 when component material 78 in the molten state is introduced into mold cavity 304. For another example, first material 322 includes a plurality of constituents of the superalloy that are present in generally the same proportions as found in the superalloy, such that local alteration of the composition of component material 78 by absorption of a relatively large amount of first material 322 is reduced.

In alternative embodiments, component material 78 is any suitable alloy, and first material 322 is at least one material that is at least partially absorbable by the molten alloy. For example, component material 78 is a cobalt-based superalloy, and first material 322 is at least one constituent of the cobalt-based superalloy, such as, but not limited to, cobalt. For another example, component material 78 is an iron-based alloy, and first material 322 is at least one constituent of the iron-based superalloy, such as, but not limited to, iron. For another example, component material 78 is a titanium-based alloy, and first material 322 is at least one constituent of the titanium-based superalloy, such as, but not limited to, titanium.

In certain embodiments, lattice structure 340 is configured to be substantially absorbed by component material 78 when component material 78 in the molten state is introduced into mold cavity 304. For example, a thickness of elongated members 346 is selected to be sufficiently small such that first material 322 of lattice structure 340 within mold cavity 304 is substantially absorbed by component material 78 when component material 78 in the molten state is introduced into mold cavity 304. In some such embodiments, first material 322 is substantially absorbed by component material 78 such that no discrete boundary delineates lattice structure 340 from component material 78 after component material 78 is cooled. Moreover, in some such embodiments, first material 322 is substantially absorbed such that, after component material 78 is cooled, first material 322 is substantially uniformly distributed within component material 78. For example, a concentration of first material 322 proximate an initial location of lattice structure 340 is not detectably higher than a concentration of first material 322 at other locations within component 80. For example, and without limitation, first material 322 is nickel and component material 78 is a nickel-based superalloy, and no detectable higher nickel concentration remains proximate the initial location of lattice structure 340 after component material 78 is cooled, resulting in a distribution of nickel that is substantially uniform throughout the nickel-based superalloy of formed component 80.

In alternative embodiments, the thickness of elongated members 346 is selected such that first material 322 is other than substantially absorbed by component material 78. For example, in some embodiments, after component material 78 is cooled, first material 322 is other than substantially uniformly distributed within component material 78. For example, a concentration of first material 322 proximate the initial location of lattice structure 340 is detectably higher than a concentration of first material 322 at other locations within component 80. In some such embodiments, first material 322 is partially absorbed by component material 78 such that a discrete boundary delineates lattice structure 340 from component material 78 after component material 78 is cooled. Moreover, in some such embodiments, first material 322 is partially absorbed by component material 78 such that at least a portion of lattice structure 340 remains intact after component material 78 is cooled.

In certain embodiments, lattice structure 340 is formed using a suitable additive manufacturing process. For example, lattice structure 340 extends from a first end 362 to an opposite second end 364, and a computer design model of lattice structure 340 is sliced into a series of thin, parallel planes between first end 362 and second end 364. A computer numerically controlled (CNC) machine deposits successive layers of first material 322 from first end 362 to second end 364 in accordance with the model slices to form lattice structure 340. Three such representative layers are indicated as layers 366, 368, and 370. In some embodiments, the successive layers of first material 322 are deposited using at least one of a direct metal laser melting (DMLM) process, a direct metal laser sintering (DMLS) process, and a selective laser sintering (SLS) process. Additionally or alternatively, lattice structure 340 is formed using another suitable additive manufacturing process.

In some embodiments, the formation of lattice structure 340 by an additive manufacturing process enables lattice structure 340 to be formed with a structural intricacy, precision, and/or repeatability that is not achievable by other methods. Accordingly, the formation of lattice structure 340 by an additive manufacturing process enables the shaping of perimeter 342 and channel 344, and thus the positioning of core 324 and internal passage 82, with a correspondingly increased structural intricacy, precision, and/or repeatability. In addition, the formation of lattice structure 340 by an additive manufacturing process enables lattice structure 340 to be formed using first material 322 that is a combination of materials, such as, but not limited to, a plurality of constituents of component material 78, as described above. For example, the additive manufacturing process includes alternating deposition of each a plurality of materials, and the alternating deposition is suitably controlled to produce lattice structure 340 having a selected proportion of the plurality of constituents. In alternative embodiments, lattice structure 340 is formed in any suitable fashion that enables lattice structure 340 to function as described herein.

Figure 6:
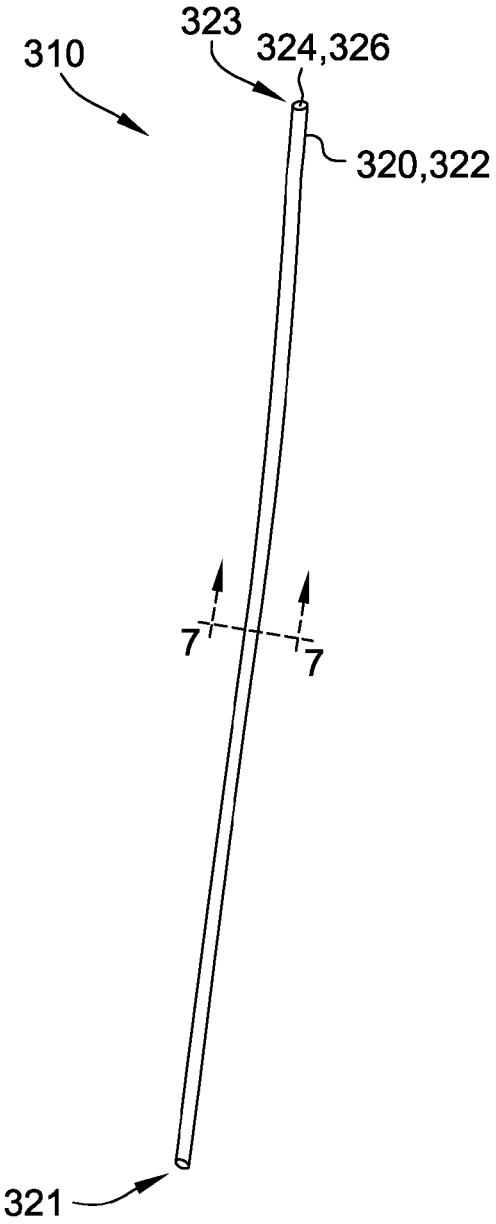
FIG. 6 is a schematic perspective view of an exemplary jacketed core that may be used with the pattern die assembly shown in FIG. 5 and the mold assembly shown in FIG. 3.
Figure 7:
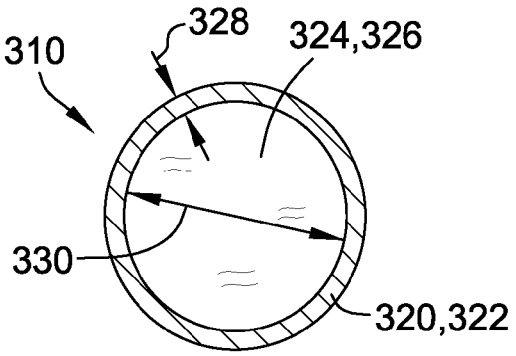
FIG. 7 is a schematic cross-section of the jacketed core shown in FIG. 6, taken along lines 7-7 shown in FIG. 6.

In certain embodiments, lattice structure 340 is formed initially without core 324, and then core 324 is inserted into channel 344. However, in some embodiments, core 324 is a relatively brittle ceramic material subject to a relatively high risk of fracture, cracking, and/or other damage. FIG. 6 is a schematic perspective view of an exemplary jacketed core 310 that may be used in place of core 324 with pattern die assembly 501 (shown in FIG. 5) and mold assembly 301 (shown in FIG. 3) to form component 80 having internal passage 82 (shown in FIG. 2) defined therein. FIG. 7 is a schematic cross-section of jacketed core 310 taken along lines 7-7 shown in FIG. 6. Jacketed core 310 includes a hollow structure 320, and core 324 formed from core material 326 and disposed within hollow structure 320. In such embodiments, hollow structure 320 extending through lattice structure 340 defines channel 344 of lattice structure 340.

In some embodiments, jacketed core 310 is formed by filling hollow structure 320 with core material 326. For example, but not by way of limitation, core material 326 is injected as a slurry into hollow structure 320, and core material 326 is dried within hollow structure 320 to form jacketed core 310. Moreover, in certain embodiments, hollow structure 320 substantially structurally reinforces core 324, thus reducing potential problems associated with production, handling, and use of unreinforced core 324 to form component 80 in some embodiments. Thus, in some such embodiments, forming and transporting jacketed core 310 presents a much lower risk of damage to core 324, as compared to using unjacketed core 324. Similarly, in some such embodiments, forming a suitable pattern in pattern die assembly 501 (shown in FIG. 5) around jacketed core 310 presents a much lower risk of damage to core 324 enclosed within hollow structure 320, as compared to using unjacketed core 324. Thus, in certain embodiments, use of jacketed core 310 presents a much lower risk of failure to produce an acceptable component 80 having internal passage 82 defined therein, as compared to the same steps if performed using unjacketed core 324 rather than jacketed core 310. Thus, jacketed core 310 facilitates obtaining advantages associated with positioning core 324 with respect to mold 300 to define internal passage 82, while reducing or eliminating fragility problems associated with core 324.

Hollow structure 320 is shaped to substantially enclose core 324 along a length of core 324. In certain embodiments, hollow structure 320 defines a generally tubular shape. For example, but not by way of limitation, hollow structure 320 is initially formed from a substantially straight metal tube that is suitably manipulated into a nonlinear shape, such as a curved or angled shape, as necessary to define a selected nonlinear shape of inner core 324 and, thus, of internal passage 82. In alternative embodiments, hollow structure 320 defines any suitable shape that enables inner core 324 to define a shape of internal passage 82 as described herein.

In the exemplary embodiment, hollow structure 320 is formed from at least one of first material 322 and a second material (not shown) that is also selected to be at least partially absorbable by molten component material 78. Thus, as with lattice structure 340, after molten component material 78 is added to mold cavity 304 and first material 322 and/or the second material is at least partially absorbed by molten component material 78, a performance of component material 78 in a subsequent solid state is not substantially degraded. Because first material 322 and/or the second material is at least partially absorbable by component material 78 in the molten state such that a performance of component material 78 in a solid state is not substantially degraded, hollow structure 320 need not be removed from mold assembly 301 prior to introducing molten component material 78 into mold cavity 304. In alternative embodiments, hollow structure 320 is formed from any suitable material that enables jacketed core 310 to function as described herein.

In the exemplary embodiment, hollow structure 320 has a wall thickness 328 that is less than a characteristic width 330 of core 324. Characteristic width 330 is defined herein as the diameter of a circle having the same cross-sectional area as core 324. In alternative embodiments, hollow structure 320 has a wall thickness 328 that is other than less than characteristic width 330. A shape of a cross-section of core 324 is circular in the exemplary embodiment shown in FIGS. 6 and 7. Alternatively, the shape of the cross-section of core 324 corresponds to any suitable shape of the cross-section of internal passage 82 (shown in FIG. 2) that enables internal passage 82 to function as described herein.

For example, in certain embodiments, such as, but not limited to, embodiments in which component 80 is rotor blade 70, characteristic width 330 of core 324 is within a range from about 0.050 cm (0.020 inches) to about 1.016 cm (0.400 inches), and wall thickness 328 of hollow structure 320 is selected to be within a range from about 0.013 cm (0.005 inches) to about 0.254 cm (0.100 inches). More particularly, in some such embodiments, characteristic width 330 is within a range from about 0.102 cm (0.040 inches) to about 0.508 cm (0.200 inches), and wall thickness 328 is selected to be within a range from about 0.013 cm (0.005 inches) to about 0.038 cm (0.015 inches). For another example, in some embodiments, such as, but not limited to, embodiments in which component 80 is a stationary component, such as but not limited to stator vane 72, characteristic width 330 of core 324 greater than about 1.016 cm (0.400 inches), and/or wall thickness 328 is selected to be greater than about 0.254 cm (0.100 inches). In alternative embodiments, characteristic width 330 is any suitable value that enables the resulting internal passage 82 to perform its intended function, and wall thickness 328 is selected to be any suitable value that enables jacketed core 310 to function as described herein.

Moreover, in certain embodiments, prior to introduction of core material 326 within hollow structure 320 to form jacketed core 310, hollow structure 320 is pre-formed to correspond to a selected nonlinear shape of internal passage 82. For example, first material 322 is a metallic material that is relatively easily shaped prior to filling with core material 326, thus reducing or eliminating a need to separately form and/or machine core 324 into a nonlinear shape. Moreover, in some such embodiments, the structural reinforcement provided by hollow structure 320 enables subsequent formation and handling of core 324 in a non-linear shape that would be difficult to form and handle as an unjacketed core 324. Thus, jacketed core 310 facilitates formation of internal passage 82 having a curved and/or otherwise non-linear shape of increased complexity, and/or with a decreased time and cost. In certain embodiments, hollow structure 320 is pre-formed to correspond to the nonlinear shape of internal passage 82 that is complementary to a contour of component 80. For example, but not by way of limitation, component 80 is rotor blade 70, and hollow structure 320 is pre-formed in a shape complementary to at least one of an axial twist and a taper of rotor blade 70, as described above.

In certain embodiments, hollow structure 320 is formed using a suitable additive manufacturing process. For example, hollow structure 320 extends from a first end 321 to an opposite second end 323, and a computer design model of hollow structure 320 is sliced into a series of thin, parallel planes between first end 321 and second end 323. A computer numerically controlled (CNC) machine deposits successive layers of first material 322 from first end 321 to second end 323 in accordance with the model slices to form hollow structure 320. In some embodiments, the successive layers of first material 322 are deposited using at least one of a direct metal laser melting (DMLM) process, a direct metal laser sintering (DMLS) process, and a selective laser sintering (SLS) process. Additionally or alternatively, hollow structure 320 is formed using another suitable additive manufacturing process.

In some embodiments, the formation of hollow structure 320 by an additive manufacturing process enables hollow structure 320 to be formed with a structural intricacy, precision, and/or repeatability that is not achievable by other methods. Accordingly, the formation of hollow structure 320 by an additive manufacturing process enables the corresponding shaping of core 324 disposed therein, and internal passage 82 defined thereby, with a correspondingly increased structural intricacy, precision, and/or repeatability. In addition, the formation of hollow structure 320 by an additive manufacturing process enables hollow structure 320 to be formed using first material 322 that is a combination of materials, such as, but not limited to, a plurality of constituents of component material 78, as described above. For example, the additive manufacturing process includes alternating deposition of each a plurality of materials, and the alternating deposition is suitably controlled to produce hollow structure 320 having a selected proportion of each of the plurality of constituents. In alternative embodiments, hollow structure 320 is formed in any suitable fashion that enables jacketed core 310 to function as described herein.

Figure 8:
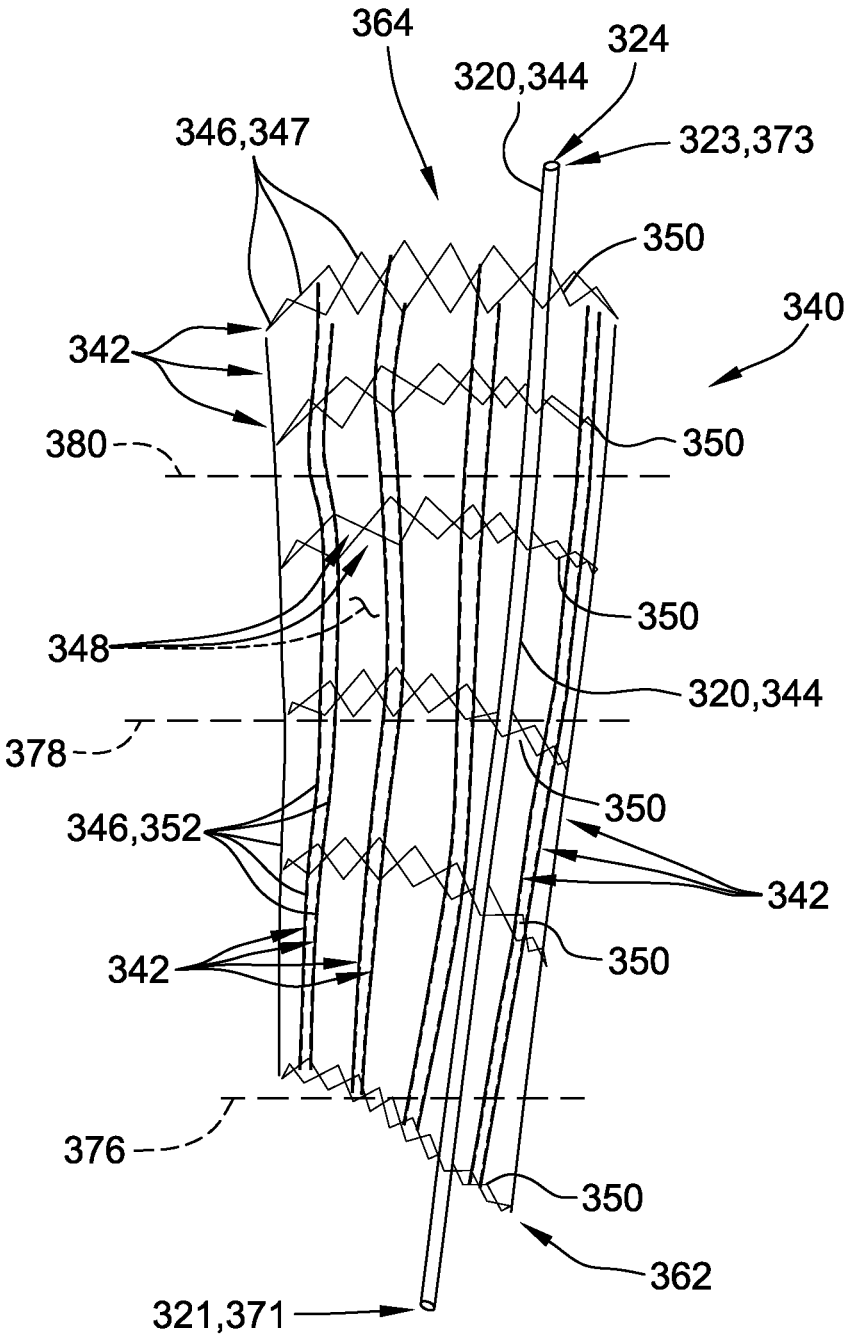
FIG. 8 is a schematic perspective view of another exemplary lattice structure for use with the mold assembly shown in FIG. 3 and the pattern die assembly shown in FIG. 5.

In certain embodiments, a characteristic of core 324, such as, but not limited to, a high degree of nonlinearity of core 324, causes insertion of a separately formed core 324, or of a separately formed jacketed core 310, into channel 344 of preformed lattice structure 340 to be difficult or impossible without an unacceptable risk of damage to core 324 or lattice structure 340. FIG. 8 is a schematic perspective view of another exemplary embodiment of lattice structure 340 that includes hollow structure 320 formed integrally, that is, formed in the same process as a single unit, with lattice structure 340. In some embodiments, forming hollow structure 320 integrally with lattice structure 340 enables core 324 having a high degree of nonlinearity to be formed therein, thus providing the advantages of both lattice structure 340 and jacketed core 310 described above, while eliminating a need for subsequent insertion of core 324 or jacketed core 310 into a separately formed lattice structure 340.

More specifically, after hollow structure 320 and lattice structure 340 are integrally formed together, core 324 is formed by filling hollow structure 320 with core material 326. For example, but not by way of limitation, core material 326 is injected as a slurry into hollow structure 320, and core material 326 is dried within hollow structure 320 to form core 324. Again in certain embodiments, hollow structure 320 extending through lattice structure 340 defines channel 344 through lattice structure 340, and hollow structure 320 substantially structurally reinforces core 324, thus reducing potential problems associated with production, handling, and use of unreinforced core 324 to form component 80 in some embodiments.

In various embodiments, lattice structure 340 formed integrally with hollow structure 320 includes substantially identical features to corresponding embodiments of lattice structure 340 formed separately, as described above. For example, lattice structure 340 is selectively positionable in the preselected orientation within die cavity 504. In some embodiments, lattice structure 340 defines perimeter 342 shaped to couple against interior wall 502 of pattern die 500 (shown in FIG. 5), such that lattice structure 340 is selectively positioned in the preselected orientation within die cavity 504. In some such embodiments, perimeter 342 conforms to the shape of interior wall 502 to position lattice structure 340 in a preselected orientation with respect to die cavity 504.

In the exemplary embodiment, each of lattice structure 340 and hollow structure 320 is formed from first material 322 selected to be at least partially absorbable by molten component material 78, as described above. In alternative embodiments, lattice structure 340 and hollow structure 320 are formed from a combination of first material 322 and at least one second material (not shown) that is selected to be at least partially absorbable by molten component material 78. Thus, after molten component material 78 is added to mold cavity 304 (shown in FIG. 3) and first material 322 and/or the second material is at least partially absorbed by molten component material 78, portion 315 of core 324 defines internal passage 82 within component 80. Because first material 322 and/or the second material is at least partially absorbable by component material 78 in the molten state such that a performance of component material 78 in a solid state is not substantially degraded, as described above, lattice structure 340 and hollow structure 320 need not be removed from mold assembly 301 prior to introducing molten component material 78 into mold cavity 304.

In some embodiments, the integral formation of lattice structure 340 and hollow structure 320 enables a use of an integrated positioning and support structure for core 324 with respect to pattern die 500 and/or mold 300. Moreover, in some embodiments, perimeter 342 of lattice structure 340 couples against interior wall 502 of pattern die 500 and/or interior wall 302 of mold 300 to selectively position lattice structure 340 in the proper orientation to facilitate relatively quick and accurate positioning of core 324 relative to, respectively, pattern die 500 and/or mold cavity 304. Additionally or alternatively, the integrally formed lattice structure 340 and hollow structure 320 are selectively positioned with respect to pattern die 500 and/or mold 300 in any suitable fashion that enables pattern die assembly 501 and mold assembly 301 to function as described herein.

In certain embodiments, lattice structure 340 and hollow structure 320 are integrally formed using a suitable additive manufacturing process. For example, the combination of lattice structure 340 and hollow structure 320 extends from a first end 371 to an opposite second end 373, and a computer design model of the combination of lattice structure 340 and hollow structure 320 is sliced into a series of thin, parallel planes between first end 371 and second end 373. A computer numerically controlled (CNC) machine deposits successive layers of first material 322 from first end 371 to second end 373 in accordance with the model slices to simultaneously form hollow structure 320 and lattice structure 340. Three such representative layers are indicated as layers 376, 378, and 380. In some embodiments, the successive layers of first material 322 are deposited using at least one of a direct metal laser melting (DMLM) process, a direct metal laser sintering (DMLS) process, and a selective laser sintering (SLS) process. Additionally or alternatively, lattice structure 340 and hollow structure 320 are integrally formed using another suitable additive manufacturing process.

In some embodiments, the integral formation of lattice structure 340 and hollow structure 320 by an additive manufacturing process enables the combination of lattice structure 340 and hollow structure 320 to be formed with a structural intricacy, precision, and/or repeatability that is not achievable by other methods. Moreover, the integral formation of lattice structure 340 and hollow structure 320 by an additive manufacturing process enables hollow structure 320 to be formed with a high degree of nonlinearity, if necessary to define a correspondingly nonlinear internal passage 82, and to simultaneously be supported by lattice structure 340, without design constraints imposed by a need to insert nonlinear core 324 into lattice structure 340 in a subsequent separate step. In some embodiments, the integral formation of lattice structure 340 and hollow structure 320 by an additive manufacturing process enables the shaping of perimeter 342 and hollow structure 320, and thus the positioning of core 324 and internal passage 82, with a correspondingly increased structural intricacy, precision, and/or repeatability. Additionally or alternatively, the integral formation of lattice structure 340 and hollow structure 320 by an additive manufacturing process enables lattice structure 340 and hollow structure 320 to be formed using first material 322 that is a combination of materials, such as, but not limited to, a plurality of constituents of component material 78, as described above. For example, the additive manufacturing process includes alternating deposition of each a plurality of materials, and the alternating deposition is suitably controlled to produce lattice structure 340 and hollow structure 320 having a selected proportion of the plurality of constituents. In alternative embodiments, lattice structure 340 and hollow structure 320 are integrally formed in any suitable fashion that enables lattice structure 340 and hollow structure 320 to function as described herein.

Figure 9:
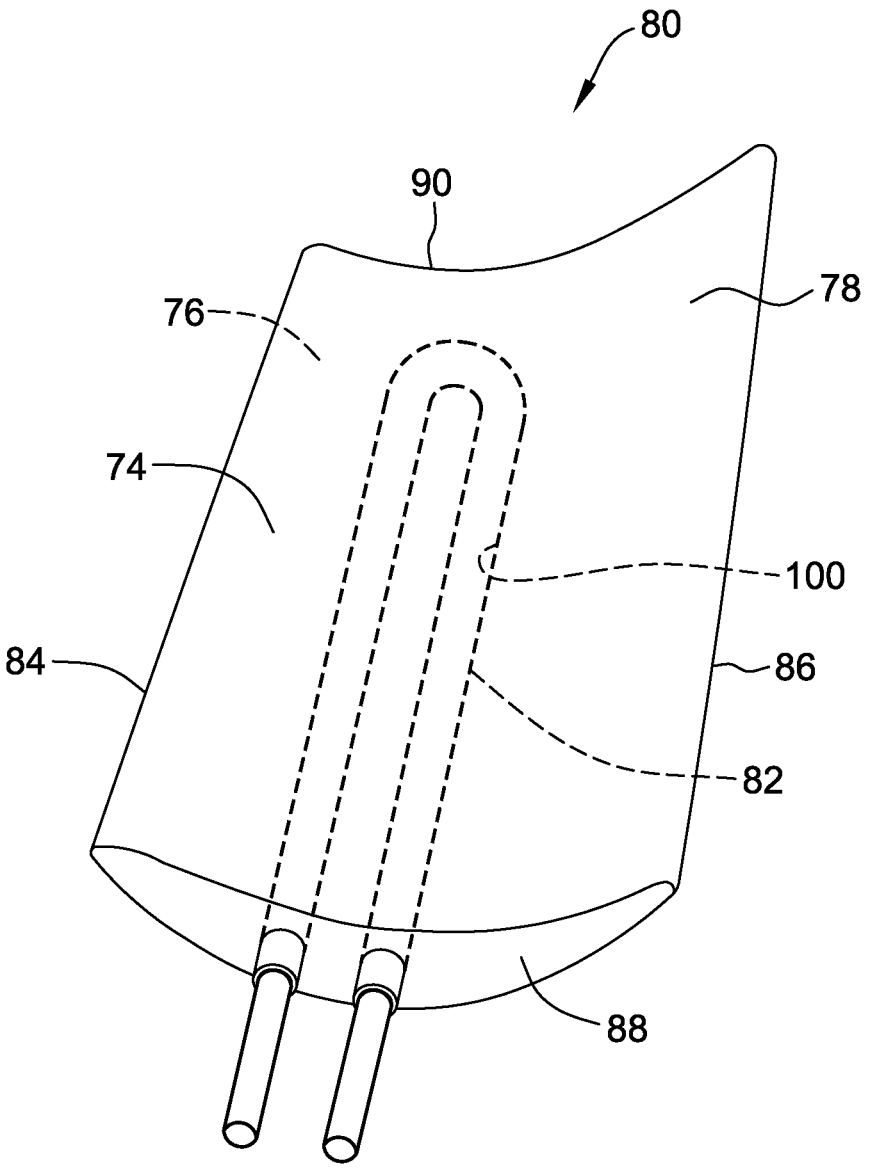
FIG. 9 is a schematic perspective view of another exemplary component for use with the rotary machine shown in FIG. 1.

FIG. 9 is a schematic perspective view of another exemplary component 80, illustrated for use with rotary machine 10 (shown in FIG. 1). Component 80 again is formed from component material 78 and includes at least one internal passage 82 defined therein. Again, although only one internal passage 82 is illustrated, it should be understood that component 80 includes any suitable number of internal passages 82 formed as described herein.

In the exemplary embodiment, component 80 is again one of rotor blades 70 or stator vanes 72 and includes pressure side 74, suction side 76, leading edge 84, trailing edge 86, root end 88, and tip end 90. In alternative embodiments, component 80 is another suitable component of rotary machine 10 that is capable of being formed with an internal passage as described herein. In still other embodiments, component 80 is any component for any suitable application that is suitably formed with an internal passage defined therein.

In the exemplary embodiment, internal passage 82 extends from root end 88, through a turn proximate tip end 90, and back to root end 88. In alternative embodiments, internal passage 82 extends within component 80 in any suitable fashion, and to any suitable extent, that enables internal passage 82 to be formed as described herein. In some embodiments, internal passage 82 has a substantially circular cross-section. In alternative embodiments, internal passage 82 has any suitably shaped cross-section that enables internal passage 82 to be formed as described herein. Moreover, in certain embodiments, the shape of the cross-section of internal passage 82 is substantially constant along a length of internal passage 82. In alternative embodiments, the shape of the cross-section of internal passage 82 varies along a length of internal passage 82 in any suitable fashion that enables internal passage 82 to be formed as described herein.

Figure 10:
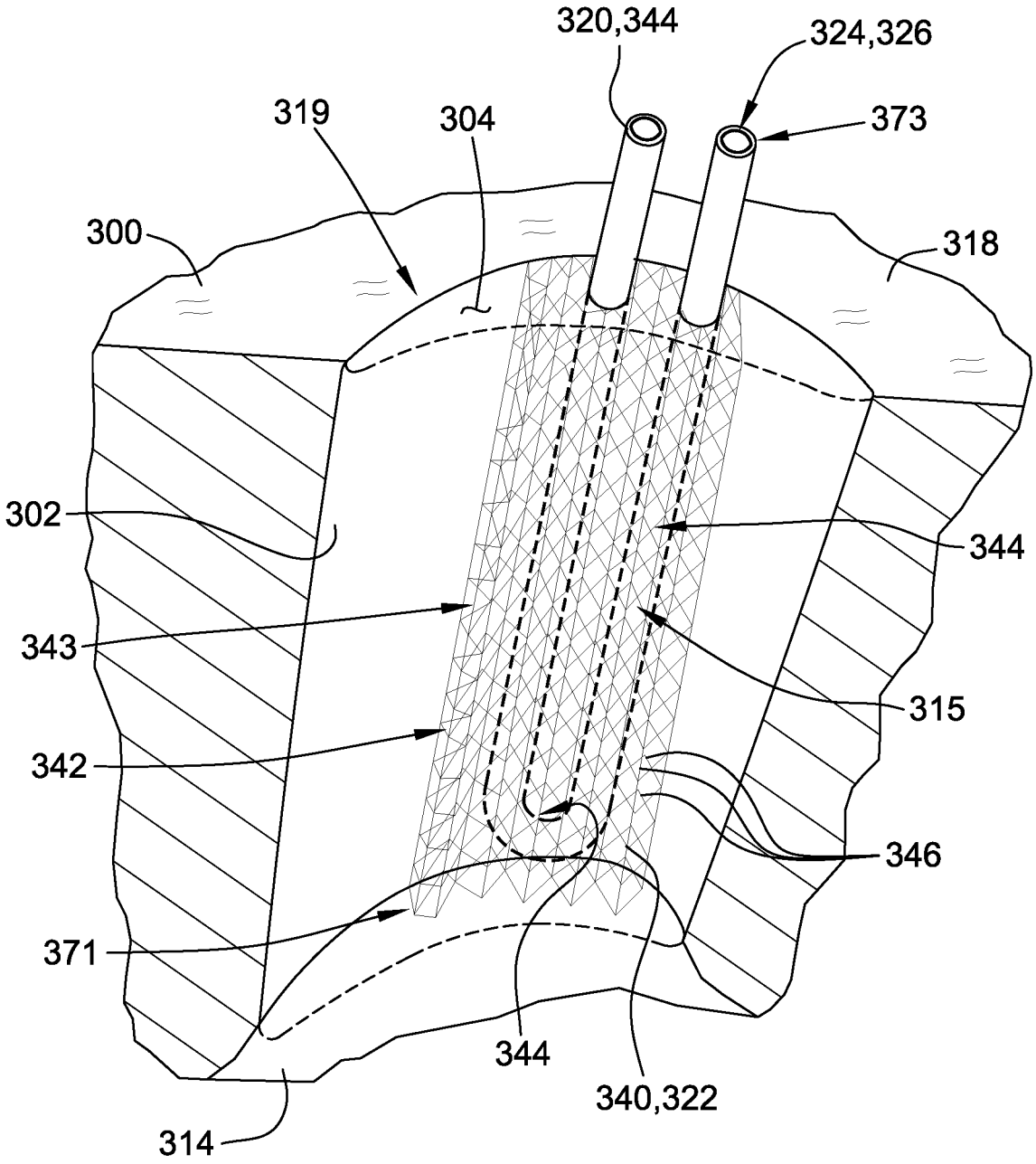
FIG. 10 is a schematic perspective cutaway view of an exemplary mold assembly for making the component shown in FIG. 9.

FIG. 10 is a schematic perspective cutaway view of another exemplary mold assembly 301 for making component 80 shown in FIG. 9. More specifically, a portion of mold 300 is cut away in FIG. 10 to enable a view directly into mold cavity 304. Mold assembly 301 again includes lattice structure 340 selectively positioned at least partially within mold cavity 304, and core 324 received by lattice structure 340. In certain embodiments, mold 300 again is formed from a pattern (not shown) made in a suitable pattern die assembly, for example similar to pattern die assembly 501 (shown in FIG. 2). In alternative embodiments, mold 300 is formed in any suitable fashion that enables mold assembly 301 to function as described herein.

In certain embodiments, lattice structure 340 again includes plurality of interconnected elongated members 346 that define plurality of open spaces 348 therebetween, and plurality of open spaces 348 is arranged such that each region of lattice structure 340 is in flow communication with substantially each other region of lattice structure 340. Moreover, in the exemplary embodiment, lattice structure 340 again includes hollow structure 320 formed integrally, that is, formed in the same process as a single unit, with lattice structure 340. Hollow structure 320 extending through lattice structure 340 again defines channel 344 through lattice structure 340. After hollow structure 320 and lattice structure 340 are integrally formed together, core 324 is formed by filling hollow structure 320 with core material 326 as described above.

In some embodiments, lattice structure defines perimeter 342 shaped for insertion into mold cavity 304 through an open end 319 of mold 300, such that lattice structure 340 and hollow structure 320 define an insertable cartridge 343 selectively positionable in the preselected orientation at least partially within mold cavity 304. For example, but not by way of limitation, insertable cartridge 343 is securely positioned with respect to mold cavity 304 by suitable external fixturing (not shown). Alternatively or additionally, lattice structure 340 defines perimeter 342 further shaped to couple against interior wall 302 of mold 300 to further facilitate selectively positioning cartridge 343 in the preselected orientation within mold cavity 304.

In some embodiments, the integral formation of lattice structure 340 and hollow structure 320 as insertable cartridge 343 increases a repeatability and a precision of, and decreases a complexity of and a time required for, assembly of mold assembly 301.

In the exemplary embodiment, each of lattice structure 340 and hollow structure 320 is again formed from at least one of first material 322 and a second material selected to be at least partially absorbable by molten component material 78, as described above. Thus, after molten component material 78 is added to mold cavity 304 and first material 322 and/or the second material is at least partially absorbed by molten component material 78, portion 315 of core 324 defines internal passage 82 within component 80. Because first material 322 and/or the second material is at least partially absorbable by component material 78 in the molten state such that a performance of component material 78 in a solid state is not substantially degraded, as described above, lattice structure 340 and hollow structure 320 need not be removed from mold assembly 301 prior to introducing molten component material 78 into mold cavity 304.

In certain embodiments, lattice structure 340 and hollow structure 320 again are integrally formed using a suitable additive manufacturing process, as described above. For example, a computer design model of the combination of lattice structure 340 and hollow structure 320 is sliced into a series of thin, parallel planes between first end 371 and second end 373, and a computer numerically controlled (CNC) machine deposits successive layers of first material 322 from first end 371 to second end 373 in accordance with the model slices to simultaneously form hollow structure 320 and lattice structure 340. In some embodiments, the successive layers of first material 322 are deposited using at least one of a direct metal laser melting (DMLM) process, a direct metal laser sintering (DMLS) process, and a selective laser sintering (SLS) process. Additionally or alternatively, lattice structure 340 and hollow structure 320 are integrally formed using another suitable additive manufacturing process.

In some embodiments, the integral formation of lattice structure 340 and hollow structure 320 by an additive manufacturing process again enables the combination of lattice structure 340 and hollow structure 320 to be formed with a structural intricacy, precision, and/or repeatability that is not achievable by other methods, enables hollow structure 320 to be formed with a high degree of nonlinearity, if necessary to define a correspondingly nonlinear internal passage 82, and enables core 324 to simultaneously be supported by lattice structure 340. In some embodiments, the integral formation of lattice structure 340 and hollow structure 320 by an additive manufacturing process again enables lattice structure 340 and hollow structure 320 to be formed using first material 322 that is a combination of materials, such as, but not limited to, a plurality of constituents of component material 78, as described above. In alternative embodiments, lattice structure 340 and hollow structure 320 are integrally formed in any suitable fashion that enables insertable cartridge 343 defined by lattice structure 340 and hollow structure 320 to function as described herein.

Figure 11:
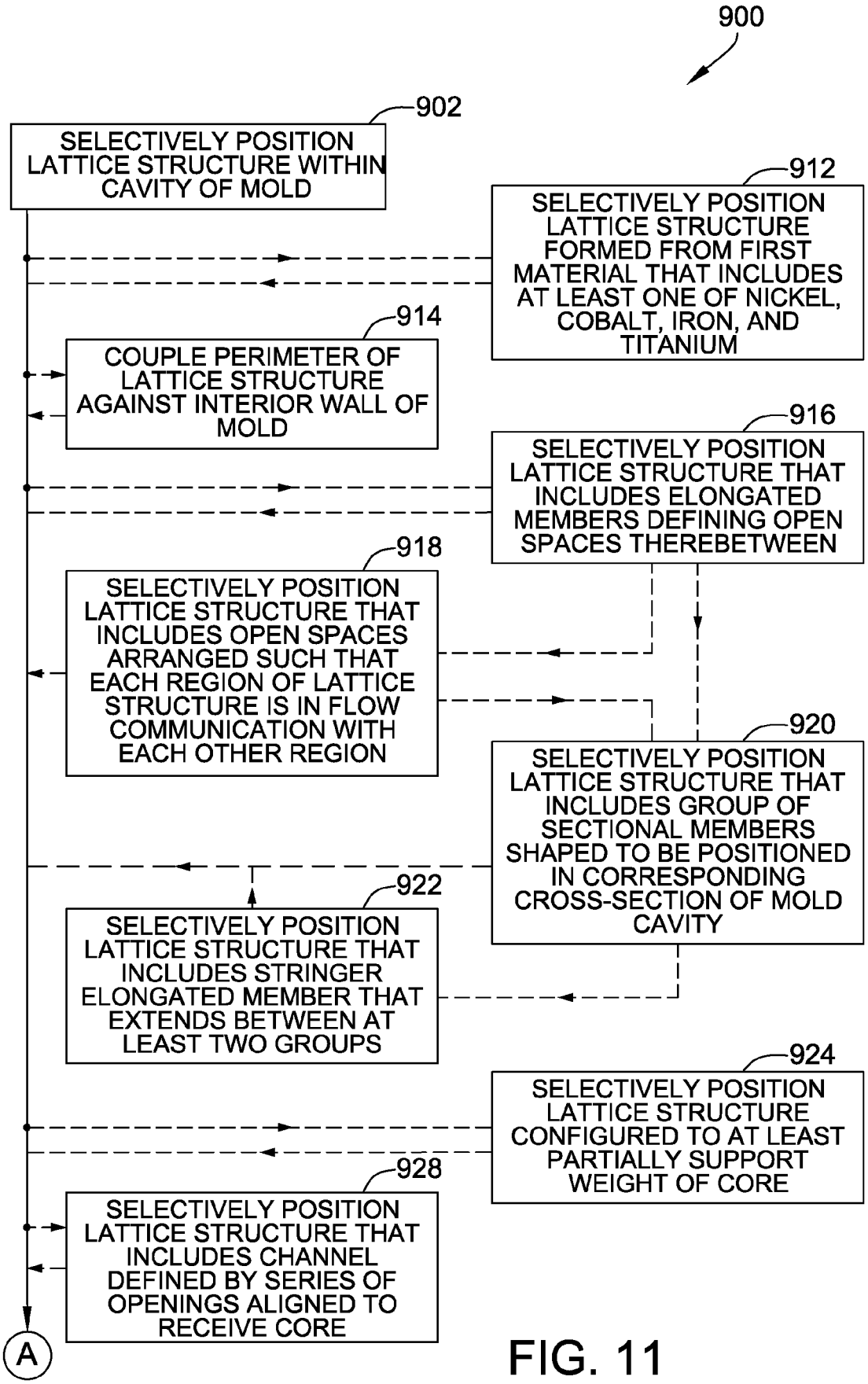
FIG. 11 is a flow diagram of an exemplary method of forming a component having an internal passage defined therein, such as the component shown in FIG. 2.
Figure 12:
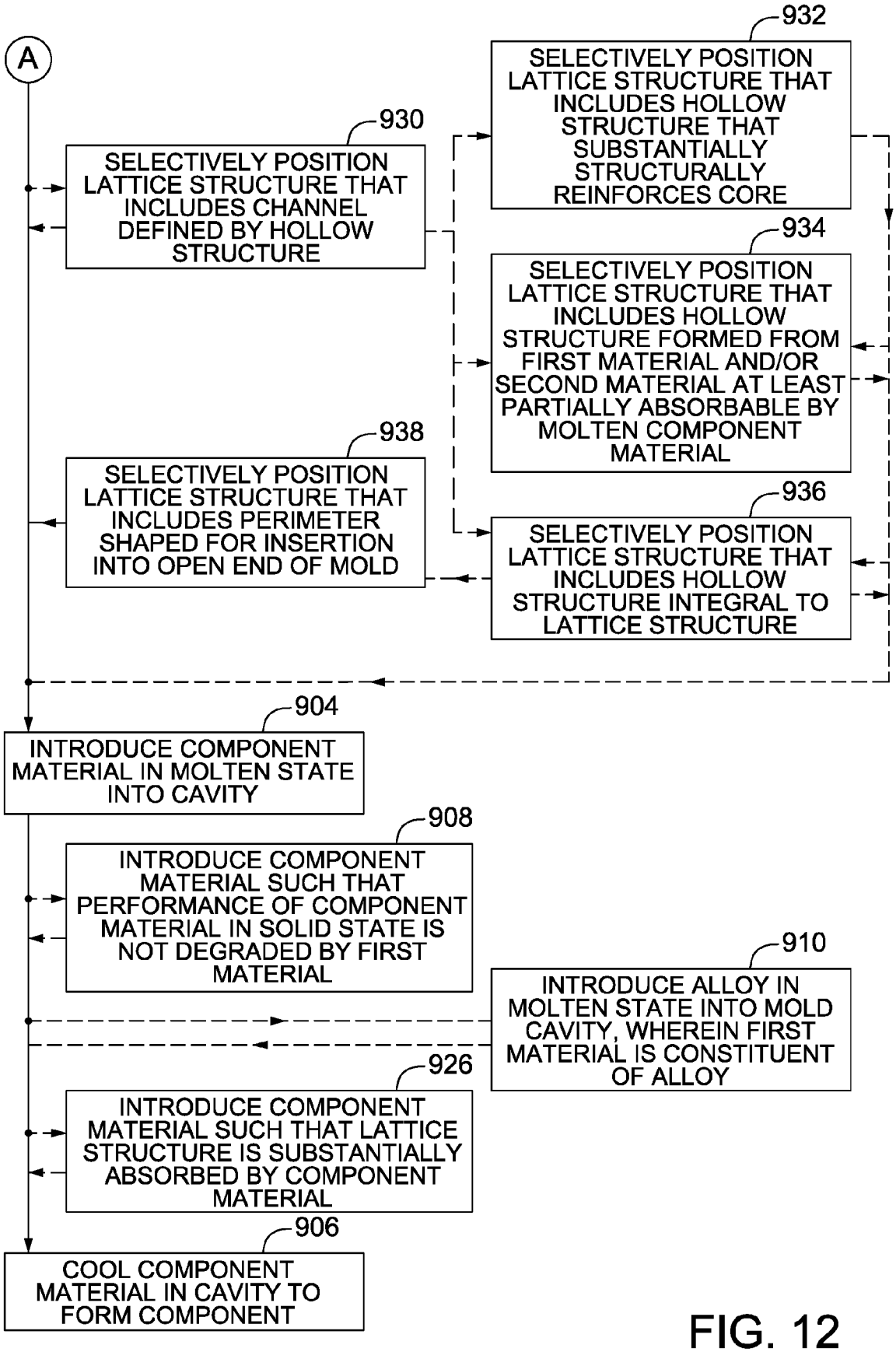
FIG. 12 is a continuation of the flow diagram from FIG. 11.

An exemplary method 900 of forming a component, such as component 80, having an internal passage defined therein, such as internal passage 82, is illustrated in a flow diagram in FIGS. 11 and 12. With reference also to FIGS. 1-10, exemplary method 900 includes selectively positioning 902 a lattice structure, such as lattice structure 340, at least partially within a cavity of a mold, such as mold cavity 304 of mold 300. The lattice structure is formed from a first material, such as first material 322. A core, such as core 324, is positioned in a channel defined through the lattice structure, such as channel 344, such that at least a portion of the core, such as portion 315, extends within the cavity.

Method 900 also includes introducing 904 a component material, such as component material 78, in a molten state into the cavity, such that the component material in the molten state at least partially absorbs the first material from the lattice structure. Method 900 further includes cooling 906 the component material in the cavity to form the component. At least the portion of the core defines the internal passage within the component.

In some embodiments, the step of introducing 904 the component material includes introducing 908 the component material such that a performance of the component material in a solid state is not degraded by the at least partial absorption of the first material. In certain embodiments, the step of introducing 904 the component material includes introducing 910 an alloy in a molten state into the mold cavity, wherein the first material comprises at least one constituent material of the alloy.

In some embodiments, the step of selectively positioning 902 the lattice structure includes selectively positioning 912 the lattice structure formed from the first material that includes at least one of nickel, cobalt, iron, and titanium.

In certain embodiments, the mold includes an interior wall, such as interior wall 302, that defines the cavity and the lattice structure defines a perimeter, such as perimeter 342, and the step of selectively positioning 902 the lattice structure includes coupling 914 the perimeter of the lattice structure against the interior wall of the mold.

In some embodiments, the step of selectively positioning 902 the lattice structure includes selectively positioning 916 the lattice structure that includes a plurality of elongated members, such as elongated members 346, that define a plurality of open spaces therebetween, such as open spaces 348. In some such embodiments, the step of selectively positioning 902 the lattice structure includes selectively positioning 918 the lattice structure that includes the plurality of open spaces arranged such that each region of the lattice structure is in flow communication with substantially each other region of the lattice structure. Additionally or alternatively, in some such embodiments, the step of selectively positioning 902 the lattice structure includes selectively positioning 920 the lattice structure that includes at least one group of sectional elongated members of the plurality of elongated members, such as group 350 of sectional elongated members 347, and each at least one group is shaped to be positioned within a corresponding cross-section of the mold cavity. In some such embodiments, the step of selectively positioning 920 the lattice structure includes selectively positioning 922 the lattice structure that includes at least one stringer elongated member of the plurality of elongated members, such as stringer elongated member 352, that extends between at least two of the groups.

In certain embodiments, the step of selectively positioning 902 the lattice structure includes selectively positioning 924 the lattice structure configured to at least partially support a weight of the core during at least one of pattern forming, shelling of the mold, and/or component forming.

In some embodiments, the step of introducing 904 the component material includes introducing 926 the component material such that the lattice structure is substantially absorbed by the component material.

In certain embodiments, the step of selectively positioning 902 the lattice structure includes selectively positioning 928 the lattice structure that includes the channel defined through the lattice structure by a series of openings in the lattice structure that are aligned to receive the core.

In some embodiments, the step of selectively positioning 902 the lattice structure includes selectively positioning 930 the lattice structure that includes the channel defined by a hollow structure, such as hollow structure 320, that encloses the core. In some such embodiments, the step of selectively positioning 902 the lattice structure includes selectively positioning 932 the lattice structure that includes the hollow structure that substantially structurally reinforces the core. Additionally or alternatively, in some such embodiments, the step of selectively positioning 902 the lattice structure includes selectively positioning 934 the lattice structure that includes the hollow structure formed from at least one of the first material and a second material that is selected to be at least partially absorbable by the component material in the molten state. Additionally or alternatively, in some such embodiments, the step of selectively positioning 902 the lattice structure includes selectively positioning 936 the lattice structure that includes the hollow structure integral to the lattice structure. In some such embodiments, the step of selectively positioning 902 the lattice structure includes selectively positioning 938 the lattice structure that defines a perimeter, such as perimeter 342, shaped for insertion into the mold cavity through an open end of the mold, such as open end 319, such that the lattice structure and the hollow structure define an insertable cartridge, such as cartridge 343.

Embodiments of the above-described lattice structure provide a cost-effective method for positioning and/or supporting a core used in pattern die assemblies and mold assemblies to form components having internal passages defined therein. The embodiments are especially, but not only, useful in forming components with internal passages having nonlinear and/or complex shapes, thus reducing or eliminating fragility problems associated with the core. Specifically, the lattice structure is selectively positionable at least partially within a pattern die used to form a pattern for the component. Subsequently or alternatively, the lattice structure is selectively positionable at least partially within a cavity of a mold formed by shelling of the pattern. A channel defined through the lattice structure positions the core within the mold cavity to define the position of the internal passage within the component. The lattice structure is formed from a material that is at least partially absorbable by the molten component material introduced into the mold cavity to form the component, and does not interfere with the structural or performance characteristics of the component or with the later removal of the core from the component to form the internal passage. Thus, the use of the lattice structure eliminates a need to remove the core support structure and/or clean the mold cavity prior to casting the component.

In addition, embodiments of the above-described lattice structure provide a cost-effective method for forming and supporting the core. Specifically, certain embodiments include the channel defined by a hollow structure also formed from a material that is at least partially absorbable by the molten component material. The core is disposed within the hollow structure, such that the hollow structure provides further structural reinforcement to the core, enabling the reliable handling and use of cores that are, for example, but without limitation, longer, heavier, thinner, and/or more complex than conventional cores for forming components having an internal passage defined therein. Also, specifically, in some embodiments, the hollow core is formed integrally with the lattice structure to form a single, integrated unit for positioning and supporting the core within the pattern die and, subsequently or alternatively, within the mold used to form the component.

An exemplary technical effect of the methods, systems, and apparatus described herein includes at least one of: (a) reducing or eliminating fragility problems associated with forming, handling, transport, and/or storage of the core used in forming a component having an internal passage defined therein; (b) enabling the use of longer, heavier, thinner, and/or more complex cores as compared to conventional cores for forming internal passages for components; (c) increasing a speed and accuracy of positioning the core with respect to a pattern die and mold used to form the component; and (d) reducing or eliminating time and labor required to remove a positioning and/or support structure for the core from the mold cavity used to cast the component.

Exemplary embodiments of lattice structures for pattern die assemblies and mold assemblies are described above in detail. The lattice structures, and methods and systems using such lattice structures, are not limited to the specific embodiments described herein, but rather, components of systems and/or steps of the methods may be utilized independently and separately from other components and/or steps described herein. For example, the exemplary embodiments can be implemented and utilized in connection with many other applications that are currently configured to use cores within pattern die assemblies and mold assemblies.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of forming a component having an internal passage defined therein, said method comprising:

inserting a preformed core through a channel defined through a lattice structure;

selectively positioning the lattice structure at least partially within a cavity of a mold, wherein at least a portion of the inserted core extends within the mold cavity;

introducing a component material in a molten state into the cavity, such that the component material in the molten state at least partially absorbs the lattice structure; and cooling the component material in the cavity to form the component, wherein at least the portion of the core defines the internal passage within the component.

2. The method of claim 1, wherein said introducing the component material in the molten state into the mold cavity comprises introducing the component material such that a performance of the component material in a solid state is not degraded by the at least partial absorption of the first material.

3. The method of claim 1, wherein said introducing the component material in the molten state into the mold cavity comprises introducing an alloy in a molten state into the mold cavity, wherein the first material comprises at least one constituent material of the alloy.

4. The method of claim 1, wherein said selectively positioning the lattice structure comprises selectively positioning the lattice structure formed from the first material that includes at least one of nickel, cobalt, iron, and titanium.

5. The method of claim 1, wherein the mold includes an interior wall that defines the cavity and the lattice structure defines a perimeter, said selectively positioning the lattice structure comprises coupling the perimeter of the lattice structure against the interior wall of the mold.

6. The method of claim 1, wherein said selectively positioning the lattice structure comprises selectively positioning the lattice structure that includes a plurality of elongated members that define a plurality of open spaces therebetween.

7. The method of claim 6, wherein said selectively positioning the lattice structure comprises selectively positioning the lattice structure that includes the plurality of open spaces arranged such that each region of the lattice structure is in flow communication with substantially each other region of the lattice structure.

8. The method of claim 6, wherein said selectively positioning the lattice structure comprises selectively positioning the lattice structure that includes at least one group of sectional elongated members of the plurality of elongated members, each at least one group is shaped to be positioned within a corresponding cross-section of the mold cavity.

9. The method of claim 8, wherein said selectively positioning the lattice structure comprises selectively positioning the lattice structure that includes at least one stringer elongated member of the plurality of elongated members that extends between at least two of the groups.

10. The method of claim 1, wherein said selectively positioning the lattice structure comprises selectively positioning the lattice structure configured to at least partially support a weight of the core during at least one of pattern forming, shelling of the mold, and/or component forming.

11. The method of claim 1, wherein said selectively positioning the lattice structure comprises selectively positioning the lattice structure that includes the channel defined through the lattice structure by a series of openings in the lattice structure that are aligned to receive the core.

12. The method of claim 1, wherein said selectively positioning the lattice structure comprises selectively positioning the lattice structure that includes the channel defined by a hollow structure that encloses the core.

13. The method of claim 12, wherein said selectively positioning the lattice structure comprises selectively positioning the lattice structure that defines a perimeter shaped for insertion into the mold cavity through an open end of the mold, such that the lattice structure and the hollow structure define an insertable cartridge.

14. A method of forming a component having an internal passage defined therein, said method comprising:

selectively positioning a lattice structure at least partially within a cavity of a mold, wherein a hollow structure is coupled to the lattice structure and defines a channel therethrough, the hollow structure enclosing a core along a length of the core, such that at least a portion of the core extends within the cavity;

introducing a component material in a molten state into the cavity, such that the component material in the molten state at least partially absorbs the lattice structure; and cooling the component material in the cavity to form the component, wherein at least the portion of the core defines the internal passage within the component.

15. The method of claim 14, wherein said selectively positioning the lattice structure comprises selectively positioning the lattice structure that includes a plurality of elongated members that define a plurality of open spaces therebetween.

16. The method of claim 15, wherein said selectively positioning the lattice structure comprises selectively positioning the lattice structure that includes the plurality of open spaces arranged such that each region of the lattice structure is in flow communication with substantially each other region of the lattice structure.

17. The method of claim 14, wherein said selectively positioning the lattice structure comprises selectively positioning the lattice structure that defines a perimeter shaped for insertion into the mold cavity through an open end of the mold, such that the lattice structure and the hollow structure define an insertable cartridge.

* * * * *